US007693453B2

(12) United States Patent
Kakui et al.

(10) Patent No.: US 7,693,453 B2
(45) **Date of Patent: *Apr. 6, 2010**

(54) IMAGE FORMING APPARATUS EQUIPPED WITH AN ELECTROGRAPHIC PHOTORECEPTOR HAVING A SURFACE WITH LOW SURFACE FREE ENERGY

(75) Inventors: Mikio Kakui, Nara (JP); Koichi Toriyama, Yao (JP); Kotaro Fukushima, Kawanishi (JP); Hisayuki Utsumi, Nara (JP); Sayaka Fujita, Kashihara (JP); Akiko Uchino, Tenri (JP); Katsuru Matsumoto, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 173 days.

This patent is subject to a terminal disclaimer.

(21) Appl. No.: 10/545,439

(22) PCT Filed: Feb. 13, 2004

(86) PCT No.: PCT/JP2004/001543

§ 371 (c)(1),
(2), (4) Date: Aug. 12, 2005

(87) PCT Pub. No.: WO2004/072738

PCT Pub. Date: Aug. 26, 2004

(65) Prior Publication Data

US 2006/0210311 A1 Sep. 21, 2006

(30) Foreign Application Priority Data

| | | |
|---|---|---|
| Feb. 14, 2003 | (JP) | P2003-036890 |
| Apr. 18, 2003 | (JP) | P2003-114433 |
| May 16, 2003 | (JP) | P2003-139078 |
| Oct. 15, 2003 | (JP) | P2003-355547 |

(51) Int. Cl.
*G03G 15/00* (2006.01)

(52) U.S. Cl. ..... 399/159

(58) Field of Classification Search ..... 399/159, 399/116, 222, 350
See application file for complete search history.

(56) References Cited

U.S. PATENT DOCUMENTS 4,724,194 A 2/1988 Shirai et al.

(Continued)

FOREIGN PATENT DOCUMENTS

JP 60-022131 A 2/1985

(Continued)

OTHER PUBLICATIONS

Kitazaki T., Hata T., et al., Nippon Secchaku Kyokaishi, Nippon Secchaku Kyokai (1972), vol. 8, No. 3, pp. 131-141.

*Primary Examiner*—David M Gray
*Assistant Examiner*—Laura K Roth
(74) *Attorney, Agent, or Firm*—Birch, Stewart, Kolasch & Birch, LLP

(57) ABSTRACT

An image forming apparatus having excellent cleaning property for an electrophotographic photoreceptor and capable of forming a high-quality, high-resolution image. A surface free energy (γ) of a photoreceptor (2), which is provided in the image forming apparatus (1), is set to 20 to 35 mN/m. A volume average diameter of toner particles included in a developer stored in a developing unit (29) to develop an electrostatic latent image and form a toner image is set to 4-7 μm When γ of the photoreceptor (2) is set to within a small range as the particle size of toner is reduced, even small-particle-size toner having increased specific surface area and largely affected by a inter-molecular force is limited in adhesion to the surface of the photoreceptor (2) to provide a good cleaning property and a high-quality image can be formed.

3 Claims, 4 Drawing Sheets

U.S. PATENT DOCUMENTS

| | | | | |
|---|---|---|---|---|
| 6,096,468 | A | 8/2000 | Ohno et al. | |
| 6,108,502 | A * | 8/2000 | Kawada et al. | 399/159 |
| 6,171,742 | B1 | 1/2001 | Kawada et al. | |
| 6,326,115 | B1 | 12/2001 | Nakanishi et al. | |
| 6,342,325 | B1 | 1/2002 | Suda et al. | |
| 7,074,531 | B2 * | 7/2006 | Fukushima et al. | 399/159 |
| 2001/0051308 | A1 * | 12/2001 | Kawamura et al. | 399/159 |
| 2002/0025184 | A1 * | 2/2002 | Ishikawa et al. | 399/159 |
| 2002/0154917 | A1 | 10/2002 | Aoki et al. | |
| 2002/0172883 | A1 * | 11/2002 | Kubo et al. | |
| 2003/0077536 | A1 | 4/2003 | Yamashita et al. | |
| 2003/0138718 | A1 | 7/2003 | Yagi et al. | |
| 2004/0120733 | A1 | 6/2004 | Aoki et al. | |

FOREIGN PATENT DOCUMENTS

| | | | |
|---|---|---|---|
| JP | 8-292641 | A | 11/1996 |
| JP | 9-152775 | A | 6/1997 |
| JP | 10-268539 | A | 10/1998 |
| JP | 10-288872 | A | 10/1998 |
| JP | 11-133666 | A | 5/1999 |
| JP | 11-311875 | A | 11/1999 |
| JP | 2001-13732 | A | 1/2001 |
| JP | 2001-66812 | A | 3/2001 |
| JP | 2001-175014 | A | 6/2001 |
| JP | 2001-235899 | A | 8/2001 |
| JP | 2001-272809 | A | 10/2001 |
| JP | 2001-272846 | A | 10/2001 |
| JP | 2002-062777 | A | 2/2002 |
| JP | 2002-62777 | A | 2/2002 |
| JP | 2002-82584 | A | 3/2002 |
| JP | 2002-131957 | A | 5/2002 |
| JP | 2002-207304 | A | 7/2002 |
| JP | 2002-214820 | A | 7/2002 |
| JP | 2002-229234 | A | 8/2002 |
| JP | 2002-244521 | A | 8/2002 |
| JP | 2002-278132 | A | 9/2002 |
| JP | 2002-278326 | A | 9/2002 |
| JP | 2002-304008 | A | 10/2002 |
| JP | 2002-304022 | A | 10/2002 |
| JP | 2002-357929 | A | 12/2002 |
| JP | 2003-84475 | A | 3/2003 |
| JP | 2003-98770 | A | 4/2003 |

* cited by examiner

IMAGE FORMING APPARATUS EQUIPPED WITH AN ELECTROGRAPHIC PHOTORECEPTOR HAVING A SURFACE WITH LOW SURFACE FREE ENERGY

FIELD OF THE INVENTION

The present invention relates to an electrophotographic image forming apparatus, for example, a copying machine or the like.

BACKGROUND ART

An electrophotographic image forming apparatus has found wide acceptance in not only a copying machine but also a printer, an output device of a computer which has been increasingly demanded in recent years. In the electrophotographic image forming apparatus, a photosensitive layer of an electrophotographic photoreceptor installed in the apparatus is uniformly charged with a charging unit, exposed to, for example, a laser beam corresponding to an image information, and a fine-grain developer called a toner is supplied to an electrostatic latent image formed by the exposure from a developing unit to form a toner image. The toner image is subjected to a transfer process before fixed to paper (medium) by a heat fuser.

The toner image formed by a developer-component toner attaching on the surface of an electrophotographic photoreceptor is transferred by transfer means to a transfer material such as recording paper. However, the toner on the surface of the electrophotographic photoreceptor is not entirely moved to the recording paper through transfer as such but is partially left on the surface of the electrophotographic photoreceptor. Such toner particles remained on the surface of the electrophotographic photoreceptor adversely affect the quality of the resulting image, and thus are eliminated by a cleaning device.

In recent years, such an electrophotographic image forming apparatus has become popular for use as not only monochrome but also as color output means, and the demand for higher-quality image formation is ever more increasing. As means for increasing the image quality, various proposals have been so far made specifically for image formation processes. The typical means therefor is reducing the particle size of toner and carrier, both of which are a developer component for use in a developing process of forming toner images by developing electrostatic latent images.

Reducing the particle size of the developer-component toner and carrier as such can increase the image quality with the better tone of images, reproducibility of thin lines, and density uniformity of solid-filled areas using a finely-manufactured magnetic brush in the developing means. What is more, with the image forming apparatus which is becoming smaller in size and faster in image formation processing speed, the level of stresses applied to a developer is reduced as the carrier is reduced in weight. As such, also in terms of durability, reducing the particle size of the carrier is considered preferable.

The problem here is that reducing the particle size of the toner causes the transfer efficiency to be lowered. This is because the toner particles are increased in attachment strength with respect to the electrophotographic photoreceptor due to image force, Van der Waals force, or others. As a result, image transfer to the transfer material becomes difficult so that the transfer efficiency is resultantly reduced. In consideration thereof, the size-reduced toner particles are shaped much rounder, and the resulting toner particles are reduced in area for contact with the surface of the electrophotographic photoreceptor so that the attachment strength is controlled. In this manner, the transfer efficiency and the image quality are both increased. Because shaping the toner particles rounder favorably increases the transfer efficiency, the toner consumption is reduced in amount per piece for copying, and the toner particles to be left in the apparatus after image transfer are reduced in amount. Accordingly, this enables beneficial image formation in view of lower cost and energy saving.

Moreover, a tendency is observed that the electrical charge density of the toner particles is intensely higher at the protrusion portion of the particles. It means that, with the higher average roundness as a result of rounding the toner particles, such nonuniformity is not observed any more to the electrical charge density of the toner particles, whereby the electrical charge characteristics are stabilized. As a result, the difference of the electrical charge characteristics is reduced between the toner particles, and this makes the amount distribution of electrical charge in the toner in its entirety, thereby achieving the higher image quality. What is more, in the rounded toner particles, the percentage occupied by the protrusion portion is less. The rubbing friction between the toner particles and the surface of the electrophotographic photoreceptor becomes thus low, and the surface of the electrophotographic photoreceptor is controlled not to suffer from film abrasion.

The issue here is that reducing the particle size of the toner and the carrier problematically causes a problem of so-called poor cleaning in a cleaning process, which is executed to eliminate any toner particles remaining on the surface of the electrophotographic photoreceptor after toner image transfer to the transfer material. Here, the poor cleaning is a phenomenon affecting the image formation process of the following cycles. This is caused by the elimination failure in the cleaning process with respect to the toner particles, which are partly left on the surface of the electrophotographic photoreceptor as a result of the transfer failure in the transfer process from the electrophotographic photoreceptor to the transfer material. To be more specific, it is the phenomenon of toner leak lines in the rotation direction of the electrophotographic photoreceptor or white fogging on the image.

As the toner particles are reduced in size, the specific surface being the surface area of the toner per unit weight is increased. This increases the effects of the intermolecular forces acting on with the electrophotographic photoreceptor per toner particle, thereby decreasing the level of cleaning performance.

The toner particles originally have the large attachment energy with respect to the surface of the electrophotographic photoreceptor. Therefore, as the average roundness is increased due to the toner particles shaped rounder, the toner particles are not scraped by a cleaning blade when the surface of the electrophotographic photoreceptor is subjected to cleaning using the cleaning blade. It means that the toner particles pass through between the edge of the cleaning blade and the surface of the electrophotographic photoreceptor with ease, resultantly the cleaning performance is problematically decreased to a further degree.

As a result of size reduction of the toner particles, such a phenomenon of the decreased cleaning performance with respect to the electrophotographic photoreceptor may be resulted from mutual attachment therebetween, associated with the size of the toner particles and the surface condition of the electrophotographic photoreceptor. In view thereof, to increase the cleaning performance of the electrophotographic photo receptor in a case of using the size-reduced toner particles, there needs to control the cleaning performance with a consideration to the surface condition of the electrophotographic photoreceptor itself.

Such a phenomenon of poor cleaning may be resulted from mutual attachment, associated with the condition of the toner particles and the surface condition of the electrophotographic photoreceptor. In view thereof, to increase the cleaning performance of the electrophotographic photoreceptor, there needs to control the cleaning performance with a consideration to the surface condition of the electrophotographic photoreceptor itself.

The most important function of the cleaning device is not to leave any toner particle on the electrophotographic photoreceptor. In addition thereto, the cleaning device is also required not to damage the electrophotographic photoreceptor, not to bring in a single foreign substance to the toner particles in the collected toner, and not to cause the cleaning features to change over a long period of time. Such a cleaning device often adopts a method of using a fast-rotating fur brush or a WEP paper sheet, for example, and generally a blade cleaning method in which a cleaning blade abuts on the electrophotographic photoreceptor to make it slide in contact therewith.

As to the process of fixing a toner image after it is transferred to a paper sheet or others during image formation, various types of methods and apparatuses have been proposed. Currently, the most general method for toner image fixation is of crimp-and-heat using a heat roller. With this crimp-and-heat method using a heat roller, the side of a toner image on the to-be-fixed sheet is made contact with the surface of the heat roller under pressure, and the roller rolls thereover for image fixation. The surface of the heat roller is made of a material that is releasable from the toner. With this crimp-and-heat method, the surface of the heat roller is made contact with the toner image on the to-be-fixed sheet under pressure. Accordingly, the heat efficiency is quite good when the toner image is fused onto the to-be-fixed sheet, enabling swift image fixing. This is considered quite effective with high-speed electrophotographic copying machines.

The issue here is that, with such a crimp-and-heat method, there needs to fix the toner image onto the to-be-fixed sheet in a short time while the heat roller is rolling thereover. Therefore, the heat roller has to be heated high in temperature. This means that the consumption energy at the time of operation of the copying machine and the printer is mostly consumed in the image fixation process.

In recent years, under the circumstances that the energy saving is in demand to decrease the loads to the global environment, reducing such a consumption energy in the image fixation process is a significant issue. In order to meet such a demand of energy saving, proposed is a low-temperature fusing toner, which can be fused at a lower temperature compared with the conventional toner. By using such a low-temperature fusing toner, it becomes possible to reduce the consumption energy in the image fixation process. The problem with the low-temperature fusing toner is that it is easily stuck to the surface of the electrophotographic photoreceptor as it is soft and has a lower-melting point compared with the conventional toner, thereby easily causing filming disadvantageously.

For solution of such problems, there is a method of eliminating the remaining toner particles and filming-occurred toner on the electrophotographic photoreceptor by increasing the abutment pressure (the load per unit length, and hereinafter referred to as line voltage) of the cleaning blade to the electrophotographic photoreceptor. The problem with this method is that increasing the line voltage surely increases the cleaning performance but also causes abrasion of a photosensitive layer of the electrophotographic photoreceptor, thereby shorting the useful life of the electrophotographic photoreceptor.

Further, in an attempt to improve the toner quality, together with the above-described low-temperature image fixation, proposed is to shape the toner particles rounder for the purpose of improving the image quality and achieving the low cost. By shaping the toner particles rounder as such, the toner particles are reduced in area of abutting on the surface of the electrophotographic photoreceptor, and thereby the attachment strength thereof can be reduced. As a result, the transfer efficiency of the toner is increased, and an amount of the toner used is reduced per image for formation so that the cost for image formation is reduced. What is more, because the toner particles become uniformly charged, the reproducibility of thin lines and others of the image can be increased. The issue here is that the rounder toner particles are difficult to be scraped by the cleaning blade at the time of cleaning, thereby problematically resulting in the poor cleaning result.

The phenomenon of poor cleaning of the electrophotographic photoreceptor as a result of temperature reduction for fixation of the toner particles and rounder shape formation thereof may be resulted from mutual attachment, associated with the toner particles and the surface condition of the electrophotographic photoreceptor. In view thereof, to increase the cleaning performance of the electrophotographic photoreceptor, there needs to go through development with a consideration to the surface condition of the electrophotographic photoreceptor itself.

Cleaning of the electrophotographic photoreceptor is to eliminate any remaining toner particles with a force acting thereon from the surface of the electrophotographic photoreceptor. The force is the one exceeding the attachment strength between the surface of the electrophotographic photoreceptor and the remaining toner particles attached thereon.

Accordingly, the lower the wettability of the surface of the electrophotographic photoreceptor, the easier the cleaning. The wettability, namely, the adhesion of the surface of the electrophotographic photoreceptor can be expressed using a surface free energy (which has the same meaning as a surface tension) as an index. The surface free energy ($\gamma$) is a phenomenon which an intermolecular force, a force acting between molecules constituting a substance, causes on the outermost surface.

A toner that remains on the surface of the electrophotographic photoreceptor by adhesion or fusion without being transferred onto a transfer member is spread on the surface of the electrophotographic photoreceptor in the form of a film while steps from charging to cleaning are repeated. This phenomenon corresponds to "adhesion wettability" in the wettability.

FIG. 5 is a side view showing a state of adhesion wettability. In the adhesion wettability shown in FIG. 5, the relation between the wettability and the surface free energy ($\gamma$) is represented by Young's formula (1).

$$\gamma_1=\gamma_2\cdot\cos\theta+\gamma_{12} \quad (1)$$

wherein $\gamma_1$: surface free energy on a surface of product 1

$\gamma_2$: surface free energy on a surface of product 2

$\gamma_{12}$: interface free energy of products 1 and 2

$\theta$: contact angle of product 2 to product 1

In formula (1), reduction in wettability of product 2 to product 1 which means that $\theta$ is increased for less wetting is attained by increasing the interface free energy $Y_{12}$ related with a wetting work of the electrophotographic photoreceptor and the foreign matters and decreasing the surface free energies $\gamma_1$ and $\gamma_2$.

When adhesion of foreign matters, a toner to the surface of the electrophotographic photoreceptor is considered in formula (1), product 1 corresponds to the electrophotographic photoreceptor and product 2 to a toner respectively. Accordingly, when the electrophotographic photoreceptor is actually cleaned, the wettability on the right side of formula (1), namely, the adhered condition of the toner to the electrophotographic photoreceptor can be controlled by controlling the surface free energy $\gamma_1$ of the electrophotographic photoreceptor.

In the prior technique that defines a surface condition of an electrophotographic photoreceptor, a contact angle with pure water is used (refer to, for example, Japanese Unexamined Patent Publication JP-A 60-22131 (1985)). However, in regard to wetting of a solid and a liquid, the contact angle θ can be measured as shown in FIG. 5, but in case of a solid and a solid such as an electrophotographic photoreceptor and a toner, the contact angle θ cannot be measured. Accordingly, the foregoing prior technique can be applied to wettability between a surface of an electrophotographic photoreceptor and pure water, but a relation between wettability and cleanability of a solid such as a toner cannot be explained satisfactorily.

With respect to an interface free energy between a solid and a solid which is deemed necessary for evaluation of a wettability between a solid and a solid, the Forkes's theory stating a non-polar intermolecular force is considered to be further extended to a component formed by a polar or hydrogen-bonding intermolecular force (refer to Kitazaki T., Hata T., et al.; "Extension of Forkes's Formula and Evaluation of Surface Tension of Polymeric Solid", Nippon Secchaku Kyokaishi, Nippon Secchaku Kyokai, 1972, vol. 8, No. 3, pp. 131-141). According to this extended Forkes's theory, the surface free energy of each product is found from2 to 3 components. The surface free energy in the adhesion wettability corresponding to the adhesion of the toner to the surface of the electrophotographic photoreceptor can be found from 3 components.

The surface free energy between solid products is described below. In the extended Forkes's theory, an addition rule of the surface free energy represented by formula (2) is assumed to be established.

$$\gamma=\gamma^d+\gamma^p+\gamma^h \tag{2}$$

wherein $\gamma^d$: dispersion component (non-polar wettability)

$\gamma^p$: dipolar component (polar wettability)

$\gamma^h$: hydrogen-bonding component (hydrogen-bonding wettability)

When the addition rule of formula (2) is applied to the Forkes's theory, the interface free energy $\gamma_{12}$ between product 1 and product 2 which are both solids is obtained as shown in formula (3).

$$\gamma_{12}=\gamma_1+\gamma_2-\{2\sqrt{(\gamma_1^d\cdot\gamma_2^d)}+2\sqrt{(\gamma_1^p\cdot\gamma_2^p)}+2\sqrt{(\gamma_1^h\cdot\gamma_2^h)}\} \tag{3}$$

wherein $\gamma_1$: surface free energy of product 1

$\gamma_2$: surface free energy of product 2

$\gamma_1^d$, $\gamma_2^d$: dispersion components of product 1 and product 2

$\gamma_1^p$, $\gamma_2^p$: dipolar components of product 1 and product 2

$\gamma_1^h$, $\gamma_2^h$: hydrogen-bonding components of product 1 and product 2

The surface free energies ($\gamma^d$, $\gamma^p$, $\gamma^h$) of the components in the solid products to be measured as represented by formula (2) can be calculated by using known reagents and measuring adhesion with the reagents. Accordingly, with respect to product 1 and product 2, it is possible that the surface free energies of the components are found and the interface free energy of product 1 and product 2 can be found from the surface free energies of the components using formula (3).

The technique of increasing the cleaning performance and the durability of the electrophotographic photoreceptor is disclosed as the related art (e.g., refer to Japanese Unexamined Patent Publications JP-A 2002-131957, JP-A 2002-229234, and JP-A 2002-304022). That is, based on the concept of the interfacial free energy between the solid substances calculated as such, the surface free energy (γ) of the electrophotographic photoreceptor including a photoconductive layer of amorphous Si is defined to be 35 to 65 mN/m or 35 to 55 mN/m, and the average diameter of the toner particles is defined to be 3 to 11 μm or 4 to 10 μm.

As to the electrophotographic photoreceptor including a photoconductive layer of an organic photosensitive material, the technique of increasing the cleaning performance on the surface of the electrophotographic photoreceptor, and achieving the longer useful life thereof by defining the surface free energy to be in the range from 35 to 65 mN/m is also disclosed in the related art (refer to Japanese Unexamined Patent Publication JP-A 11-311875 (1999)).

However, the inventors of the present invention use the electrophotographic photoreceptor having the surface free energy (γ) of 35 to 65 mN/m being the range disclosed in the related arts to conduct an actual performance test by actually forming an image with respect to a recording paper. As a result of such a test study, the surface of the electrophotographic photoreceptor is observed with flaws that are possibly resulted from exposure to foreign substances such as paper powder. Also observed on the image transferred to the recording paper are black streaks resulted from poor cleaning due to those flaws.

In still the related art which is disclosed in JP-A 11-311875, an amount (Δγ) of change in surface free energy according to duration of an electrophotographic photoreceptor is defined. However, in consideration of the facts that the amount (Δγ) of change is not determined by defining initial characteristics, for example, the surface free energy, of the electrophotographic photoreceptor and the amount (Δγ) of change varies depending on conditions such as an environment in image formation and a material of a transfer member, the amount (Δγ) of change is problematic in that it might include an uncertain element and is therefore inappropriate as a designing standard in actual designing of an electrophotographic photoreceptor.

The related art about increasing the quality and the resolution of to-be-formed images includes the following techniques. The one technique is of defining the volume average diameter of magnetic toner particles to be 4 to 9 μm, providing specific inorganic particles into the very surface layer of the electrophotographic photoreceptor, and defining the surface roughness Rz to be 0.1 to 1.0 μm (refer to Japanese Unexamined Patent Publication JP-A9-152775 (1997)). The other technique is of defining the volume average diameter of toner particles to be 5 to 10 μm and the volume average diameter of carriers to be 15 to 45 μm, and defining the relationship between the surface friction coefficient of the electrophotographic photoreceptor and the kinetic friction coefficient of a magnetic brush (refer to Japanese Unexamined Patent Publication JP-A 2002-207304).

The concern here is that neither JP-A 9-152775 nor JP-A 2002-207304 discloses a technique of solving the decreasing cleaning performance resulted from particle size reduction as described above. Moreover, with the technique disclosed in JP-A 9-152775, there needs to prepare an electrophotographic photoreceptor whose very surface has specific inorganic particles scattered thereon. This raises a problem in view of productivity.

There are still other related arts, and one is proposing a technique of increasing the cleaning performance and deriving high-quality images with stability by defining the surface free energy to be 40 to 80 mN/m for the electrophotographic photoreceptor including a layer of siloxane resin serving as a surface protection layer, by defining the average diameter of the toner particle to be 4 to 12 μm, and by defining the average amount of electrical charge (refer to Japanese Unexamined Patent Publication JP-A 2001-272809). The problem with the technique disclosed in JP-A 2001-272809 is that the sensitivity and the electrification stability are not practically enough due to such a structure that the protection layer is placed on the surface of the electrophotographic photoreceptor. What is more, the production efficiency is not good.

The related art of proposing to increase the quality of images by shaping the toner particles rounder uses a magnetic toner to derive images with extremely little fogging (refer to Japanese Unexamined Patent Publication JP-A 2001-235899). The magnetic toner is the one including inorganic fine powder and conductive powder on the surfaces of magnetic toner particles including a bonding resin and a magnetic substance. By defining the average roundness of such magnetic toner particles to be 0.970 or more, every particle of the magnetic toner becomes uniformly charged. However, JP-A2001-235899is not disclosing a technique of solving the problem of causing poor cleaning, resulting from the fact that, as the average roundness of the toner particles is increased, the remaining toner particles can easily pass through between the edge of the cleaning blade and the surface of the electrophotographic photoreceptor.

There is still another technique of achieving energy saving and preventing filming by using a toner having a specific glass transition temperature (Tg) with respect to the electrophotographic photoreceptor with the surface free energy (γ) of 35 to 65 mN/m (refer to JP-A2002-131957) . In the technique disclosed in JP-A 2002-131957, however, the electrophotographic photoreceptor is limited to be of amorphous silicon. Although the amorphous-silicon photoreceptor has good hardness and can achieve the long user life, it is quite high in manufacture cost compared with an organic electrophotographic photoreceptor. Further, compared with a multi-layered organic electrophotographic photoreceptor varying in material type for selection and in characteristics, the design flexibility is narrower.

DISCLOSURE OF THE INVENTION

An object of the invention is to provide an image forming apparatus showing a good cleaning performance with respect to an electrophotographic photoreceptor, and being capable of forming high-quality high-resolution images.

Another object of the invention is to provide an image forming apparatus showing a high transfer efficiency and good cleaning performance with respect to an electrophotographic photoreceptor by defining a range for the average roundness of toner particles and the surface free energy on the surface of the electrophotographic photoreceptor, and being capable of forming high-quality high-resolution images.

Still another object of the invention is to provide an image forming apparatus that shows good cleaning performance with respect to an electrophotographic photoreceptor by defining a range for the average amount of electrical charge of the toner and the surface free energy on the surface of the electrophotographic photoreceptor, and is capable of forming high-quality high-resolution images.

Still another object of the invention is to provide an image forming apparatus causing no poor cleaning even with using a low-melting toner by defining a range for the surface free energy on the surface of an electrophotographic photoreceptor.

The invention is an image forming apparatus, including: an electrophotographic photoreceptor provided with a photosensitive layer that is exposed to light corresponding to image information for formation of an electrostatic latent image; developing means for developing the electrostatic latent image and forming a toner image by supplying a toner included in a developer onto the surface of the photosensitive layer of the electrophotographic photoreceptor; transfer means for transferring the toner image to a transfer material serving as a recording medium; and cleaning means for eliminating residual toner particles left on the surface of the electrophotographic photoreceptor after the toner image is transferred to the transfer material, wherein a volume average diameter of the toner particles included in the developer is 4 μm or larger but 7 μm or smaller, and a surface free energy (γ) on the surface of the photosensitive layer of the electrophotographic photoreceptor is 20 mN/m or more but 35 mN/m or less.

Furthermore, the invention is characterized in that the surface free energy (γ) on the surface of the photosensitive layer of the electrophotographic photoreceptor is 28 mN/m or more but 35 mN/m or less.

According to the invention, a setting is so made that the volume average diameter of the toner particles included in the developer is 4 μm or larger but 7 μm or smaller, and the surface energy on the surface of the electrophotographic photoreceptor is 20 mN/m or more but 35 mN/m or less, preferably 28 mN/m or more but 35 mN/m or less. The surface free energy of the electrophotographic photoreceptor herein is the one calculated and derived by Forkes extended theory described above.

The surface free energy on the surface of the electrophotographic photoreceptor serves as an index of the attachment strength of the toner with respect to the surface of the electrophotographic photoreceptor. With the aim of improving the image quality and resolution, as the toner particles are reduced in size, the specific surface being the surface area of the toner particles per unit weight is increased. This greatly affects the intermolecular forces, and thus the attachment strength is increased with respect to the electrophotographic photoreceptor. When the size of the toner particles is set to be 4 to 7 μm, which is a range suitable for increasing the image quality and resolution, by setting the surface free energy of the electrophotographic photoreceptor to the above-described suitable range, it becomes possible to provide the toner particles with the attachment strength of the level needed for image development while suppressing excessive attachment strength. Therefore, the toner particles, especially the remaining toner particles can be easily eliminated from the surface of the electrophotographic photoreceptor.

As such, it becomes possible to increase the cleaning performance without lowering the image development performance, and thus implemented is an image forming apparatus that shows good cleaning performance even with using size-reduced toner particles, and is capable of stably forming high-quality high-resolution images over a long period of time.

Furthermore, the invention is an image forming apparatus, including: an electrophotographic photoreceptor provided with a photosensitive layer that is exposed to light corresponding to image information for formation of an electrostatic latent image; developing means for developing the electrostatic latent image and forming a toner image by supplying a toner included in a developer onto the surface of the photosensitive layer of the electrophotographic photoreceptor; transfer means for transferring the toner image to a transfer material serving as a recording medium; and cleaning means for eliminating residual toner particles left on the surface of the electrophotographic photoreceptor after the toner image is transferred to the transfer material, wherein an average roundness of the toner particles included in the developer is 0.95 or more, and a surface free energy (γ) on the surface of the photosensitive layer of the electrophotographic photoreceptor is 20 mN/m or more but 35 mN/m or less.

Furthermore, the invention is characterized in that the surface free energy (γ) on the surface of the photoreceptor of the electrophotographic photoreceptor is 28 mN/m or more but 35 mN/m or less.

According to the invention, a setting is so made that the average roundness of the toner particles included in the developer is 0.95 or more, and the surface energy on the surface of the electrophotographic photoreceptor is 20 mN/m or more but 35 mN/m or less, preferably 28 mN/m or more but 35 mN/m or less. The surface free energy of the electrophotographic photoreceptor herein is the one calculated and derived by Forkes extended theory described above. The surface free energy on the surface of the electrophotographic photoreceptor serves as an index of the attachment strength of the toner with respect to the surface of the electrophotographic photoreceptor.

With the aim of improving the image quality and resolution, the small-sized toner particles are shaped rounder, and as the average roundness thereof is increased, the toner particles become uniformly charged to a further degree. By setting the average roundness of the toner particles to 0.95 or more, the toner particles become uniformly charged to a further degree as such, thereby implementing image formation achieving high-quality and high-resolution. Although increasing the average roundness of the toner particles generally leads to a difficulty of scraping the toner particles remaining on the surface of the electrophotographic photoreceptor using a cleaning blade, by setting the surface free energy of the electrophotographic photoreceptor to the above-described suitable range, it becomes possible to provide the toner particles with the attachment strength of the level needed for image development while suppressing excessive attachment strength. Therefore, the remaining toner particles can be scraped using the cleaning blade with ease, favorably implementing the good cleaning performance. What is more, by setting the surface free energy of the electrophotographic photoreceptor to the above-described suitable range, it becomes possible to increase the transfer efficiency which is the transfer ratio from the surface of the electrophotographic photoreceptor to the transfer material. As such, it becomes possible to control the amount of toner particles to be left on the element surface.

As such, without lowering the image development performance, it becomes possible to increase the transfer efficiency and control the amount of toner particles to be left on the element surface, and even if any toner particles are left on the element surface, thus left toner particles are easily scraped by a cleaning blade, favorably realizing the good cleaning performance. Therefore, implemented is an image forming apparatus that shows good transfer efficiency and cleaning performance even with using round-shaped toner particles of higher-average-roundness, and is capable of stably forming high-quality high-resolution images over a long period of time.

Furthermore, the invention is an image forming apparatus, including: an electrophotographic photoreceptor provided with a photosensitive layer that is exposed to light corresponding to image information for formation of an electrostatic latent image; developing means for developing the electrostatic latent image and forming a toner image by supplying a toner included in a developer onto the surface of the photosensitive layer of the electrophotographic photoreceptor; transfer means for transferring the toner image to a transfer material serving as a recording medium; and cleaning means for eliminating residual toner particles left on the surface of the electrophotographic photoreceptor after the toner image is transferred to the transfer material, wherein an average amount of electrical charge of the toner included in the developer is 10 μC/g or more but 30 μC/g or less, and a surface free energy (γ) on the surface of the photosensitive layer of the electrophotographic photoreceptor is 20 mN/m or more but 35 mN/m or less.

Furthermore, the invention is characterized in that the surface free energy (γ) on the surface of the photosensitive layer of the electrophotographic photoreceptor is 28 mN/m or more but 35 mN/m or less.

According to the invention, a setting is so made that the average amount of electrical charge of the toner included in the developer is 10 μC/g or more but 30 μC/g or less, and the surface free energy on the surface of the electrophotographic photoreceptor is 20 mN/m or more but 35 mN/m or less, preferably 28 mN/m or more but 35 nN/m or less. The surface free energy of the electrophotographic photoreceptor herein is the one calculated and derived by Forkes extended theory described above.

The surface free energy on the surface of the electrophotographic photoreceptor and the average amount of electrical charge of the toner both serve as an index of the attachment strength of the toner with respect to the surface of the electrophotographic photoreceptor. By setting the surface free energy of the electrophotographic photoreceptor and the average amount of electrical charge of the toner to the above-described suitable range, it becomes possible to provide the attachment strength of the level needed for image development while suppressing excessive attachment strength between the electrophotographic photoreceptor and the toner particles. Therefore, the remaining toner particles can be scraped using the cleaning blade with ease, favorably realizing the good cleaning performance. As such, the good cleaning performance can be realized without lowering the image development performance, implemented is an image forming apparatus that is capable of stably forming high-quality high-resolution images over a long period of time.

Furthermore, the invention is characterized in that the volume average diameter of the toner particles is 4 μm or larger but 7 μm or smaller.

According to the invention, the volume average diameter of the toner particles is set to be 4 to 7 μm. By reducing the diameter of the toner particles as such, the resulting images can be high in quality and resolution. On the other hand, as the toner particles are reduced in diameter as such, the specific surface being the surface area of the toner particles per unit weight is increased. This greatly affects the intermolecular forces, and thus the attachment strength is increased with respect to the electrophotographic photoreceptor. However, by setting the surface free energy of the electrophotographic photoreceptor to be in a suitable range, it becomes possible to provide the toner particles with the attachment strength of the level needed for image development while suppressing excessive attachment strength. Therefore, the toner particles, especially the remaining toner particles can be scraped with ease from the surface of the electrophotographic photoreceptor. As such, implemented is an image forming apparatus that shows good cleaning performance even with using size-reduced toner particles, and is capable of stably forming high-quality high-resolution images over a long period of time.

Furthermore, the invention is an image forming apparatus, including: an electrophotographic photoreceptor provided with a photosensitive layer that is exposed to light corresponding to image information for formation of an electrostatic latent image; developing means for developing the electrostatic latent image and forming a toner image by supplying a toner included in a developer onto the surface of the photosensitive layer of the electrophotographic photoreceptor; transfer means for transferring the toner image to a transfer material serving as a recording medium; and cleaning means for eliminating residual toner particles left on the surface of the electrophotographic photoreceptor after the toner image is transferred to the transfer material, wherein a glass transition temperature (Tg) of the toner particles included in the developer is exceeding 20° C. but lower than 60° C., and a surface free energy (γ) on the surface of the photosensitive layer of the electrophotographic photoreceptor is 20 mN/m or more but 35 mN/m or less.

According to the invention, a setting is so made to the toner particles that the glass transition temperature (Tg) exceeds 20° C. but lower than 60° C., and the surface free energy (γ) on the surface of the electrophotographic photoreceptor is 20 mN/m or more but 35 mN/m or less, preferably 28 mN/m or more but 35 mN/m or less. The surface free energy of the electrophotographic photoreceptor herein is the one calculated and derived by Forkes extended theory described above. The surface free energy on the surface of the electrophotographic photoreceptor serves as an index of the attachment strength of the toner with respect to the surface of the electrophotographic photoreceptor.

As described in the foregoing, the toner has the characteristics of low-melting point, and thus can save the consumption energy in the image fixation process of fixing a toner image onto a transfer material serving as a recording medium. The issue here is that the low-melting toner easily causes filming by attaching onto the surface of the electrophotographic photoreceptor. However, because the surface free energy of the electrophotographic photoreceptor is set to a low range of 20 to 35mN/m, even if the toner particles attach on the surface of the electrophotographic photoreceptor, those can be eliminated with ease by a cleaning blade passing thereover. This is thanks to low interaction between the toner particles and the surface of the electrophotographic photoreceptor, thereby leading to the good cleaning performance. In such a manner, implemented is an image forming apparatus that is free from poor cleaning result even with using a low-melting toner.

Further, the invention is characterized in that an average roundness of the toner particles is 0.950 or more.

According to the invention, the toner is provided with the low-temperature fusibility, and additionally, the toner particles are so shaped as to have the average roundness of 0.950 or more. By setting the average roundness of the toner particles to 0.950 or more, the toner particles become uniformly charged to a greater extent so that high-quality high-resolution image formation is implemented. Although increasing the average roundness of the toner particles generally leads to a difficulty of scraping the toner particles remaining on the surface of the electrophotographic photoreceptor using a cleaning blade, by setting the surface free energy of the electrophotographic photoreceptor to the range of 20 to 35 mN/m, it becomes possible to provide the toner particles with the attachment strength of the level needed for image development while suppressing excessive attachment strength. Therefore, the remaining toner particles can be scraped using the cleaning blade with ease, favorably implementing the good cleaning performance. What is more, by setting the surface free energy of the electrophotographic photoreceptor to the above-described suitable range, it becomes possible to increase the transfer efficiency being the transfer ratio from the surface of the electrophotographic photoreceptor to the transfer material. As such, it becomes possible to control the amount of toner particles to be left on the element surface.

As such, without lowering the image development performance, it becomes possible to increase the transfer efficiency and control the amount of toner particles to be left on the element surface, and even if any toner particles are left on the element surface, thus left toner particles are easily scraped by a cleaning blade, favorably realizing the good cleaning performance. Therefore, implemented is an image forming apparatus that shows good transfer efficiency and cleaning performance even with using round-shaped toner particles of higher-average-roundness, and is capable of stably forming high-quality high-resolution images over a long period of time.

Furthermore, the invention is characterized in that the cleaning means includes a cleaning blade that abuts on the electrophotographic photoreceptor to eliminate the toner particles on the surface of the electrophotographic photoreceptor, and a line voltage of the cleaning blade abutting on the electrophotographic photoreceptor is 10 gf/cm or more but 35 gf/cm or less.

According to the invention, a setting is so made that the line voltage of the cleaning blade provided to the cleaning means falls in the range of 10 to 35 gf/cm with respect to the electrophotographic photoreceptor. On the other hand, because the surface free energy of the electrophotographic photoreceptor is set to the range of 20 to 35mN/m, the interaction between the toner particles and the electrophotographic photoreceptor is controlled, i.e., the toner particles are so controlled as not to attach too much onto the surface of the electrophotographic photoreceptor. Therefore, even with the relatively-low line voltage of the cleaning blade as described above, the toner particles remaining on the surface of the electrophotographic photoreceptor are easily eliminated, thereby causing no poor cleaning result. What is more, because the line voltage of the cleaning blade is low with respect to the electrophotographic photoreceptor, the electrophotographic photoreceptor is controlled not to suffer from abrasion, and the useful life of the apparatus is lengthened. As such, implemented is an image forming apparatus that is free from poor image quality resulted from the poor cleaning result even with the long-term use.

Furthermore, the invention is characterized in that the photosensitive layer of the electrophotographic photoreceptor is made of an organic photoconductive material.

According to the invention, the photosensitive layer of the electrophotographic photoreceptor is made of an organic photoconductive material. This eases material design of the electrophotographic photoreceptor, thereby realizing the lower cost and higher-efficient production.

Furthermore, the invention is characterized in that the photosensitive layer is formed by laminating a charge generating layer containing a charge generating substance and a charge transporting layer containing a charge transporting substance.

According to the invention, the photosensitive layer of the electrophotographic photoreceptor is formed by laminating a charge generating layer containing a charge generating substance and a charge transporting layer containing a charge transporting substance. The photosensitive layer is thus formed by laminating plural layers to thereby freely select materials constituting the respective layers and their combinations. Consequently, the surface free energy value on the surface of the electrophotographic photoreceptor can easily be determined in a desired range.

BRIEF DESCRIPTION OF THE DRAWINGS

Other and further objects, features, and advantages of the invention will be more explicit from the following detailed description taken with reference to the drawings wherein.

BEST MODE FOR CARRYING OUT THE INVENTION

Figure 1:
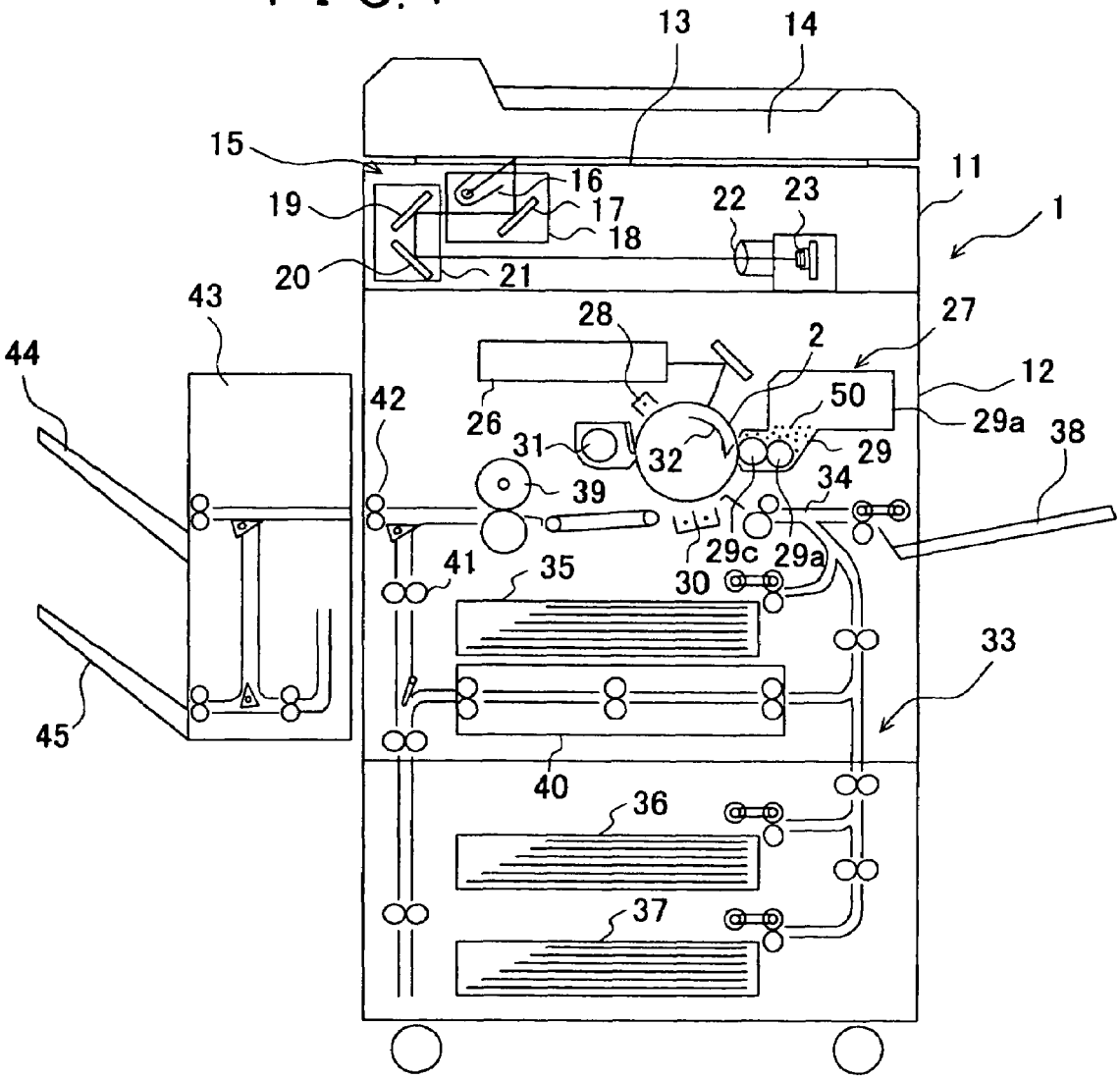
FIG. 1 is a placement diagram, viewed from the side, showing the simplified structure of an image forming apparatus 1 according to an embodiment of the invention.
Figure 2:
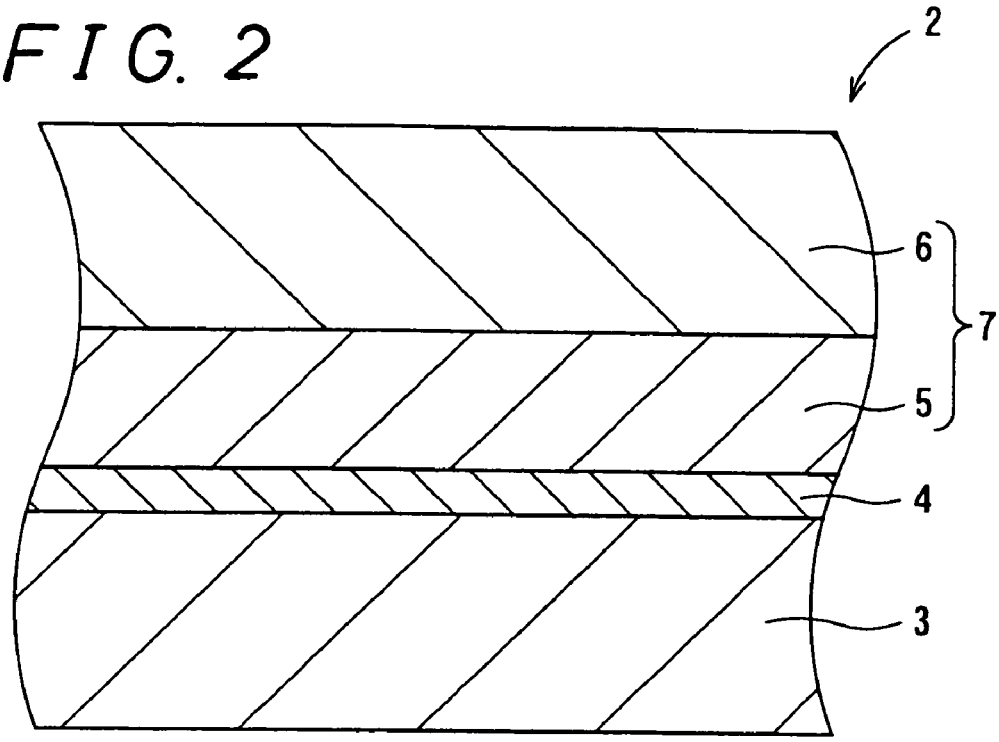
FIG. 2 is a partial cross sectional view showing the simplified structure of an electrophotographic photoreceptor 2 provided to the image forming apparatus 1 of FIG. 1.

In the below, by referring to the accompanying drawings, preferred embodiments of an image forming apparatus of the invention are described. FIG. 1 is a placement diagram, viewed from the side, showing the simplified structure of an image forming apparatus 1 according to an embodiment of the invention, and FIG. 2 is a partial cross sectional view showing the simplified structure of an electrophotographic photoreceptor 2 provided to the image forming apparatus 1 of FIG. 1.

Described first is the electrophotographic photoreceptor 2 (hereinafter, simply referred to as photoreceptor), which is a main structure component of the image forming apparatus 1 of the invention. The photoreceptor 2 is provided with a conductive support 3 made of a conductive material, a lower layer 4 that is overlaid on the conductive support 3, a charge generating layer 5 that is overlaid on the lower layer 4 and including a charge generating substance, and a charge transporting layer 6 that is overlaid on the charge generating layer 5 and including a charge transporting substance. The charge generating layer 5 and the charge transporting layer 6 configure a photosensitive layer 7.

The conductive substrate 3 has a cylindrical shape. A substrate obtained by forming a conductive layer of aluminum, copper, palladium, tin oxide or indium oxide on a surface of (a) a metallic material such as aluminum, stainless steel, copper or nickel or (b) an insulation material such as a polyester film, a phenolic resin pipe or a paper pipe is preferably used. It has preferably conductivity with volume resistivity of $10^{10}$ Ω·cm or less. The surface of the conductive substrate 3 may be oxidized for controlling the volume resistance. The conductive substrate 3 plays a part of an electrode of the photoreceptor 2 and also serves as a support member of the other layers 4, 5 and 6. The shape of the conductive substrate 3 is not limited to the cylindrical shape, and the substrate may be formed in a shape of a plate, a film or a belt.

The undercoat layer 4 is formed of, for example, a polyamide, a polyurethane, a cellulose, nitrocellulose, polyvinyl alcohol, polyvinyl pyrrolidone, polyacrylamide, an aluminum anodic oxide film, gelatin, starch, casein or an N-methoxymethylated nylon. Further, grains of titanium oxide, tin oxide, aluminum oxide or the like may be dispersed in the undercoat layer 4. The undercoat layer 4 is formed with the film thickness of from approximately 0.1 to 10 μm. This undercoat layer 4 plays a part of an adhesive layer between the conductive substrate 3 and the photosensitive layer 7, and also serves as a barrier layer of inhibiting flow of charges from the conductive substrate 3 to the photosensitive layer 7. The undercoat layer 4 thus acts to maintain charge ability of the photoreceptor 2, making it possible to prolong the life of the photoreceptor 2.

The charge generating layer 5 may be configured by including a well-known charge generating substance. The charge generating substance may be any of inorganic pigment, organic pigment, and organic dye as long as it absorbs visible radiation and generates free electrical charge. The inorganic pigment is exemplified by selenium, alloys thereof, arsenic-selenium, cadmium sulfide, zinc oxide, amorphous silicon, and any other type of inorganic photoconductors. The organic pigment is exemplified by phthalocyanine compound, azoxy compound, quinacridone compound, polycyclic quinine compound, perylene compound, and others. The organic dye is exemplified by thiopyrylium salt, squarylium salt, and others. Among the above-described charge generating substances, the phthalocyanine compound is suitably used, especially using titanyl phthalocyanine compound is considered most suitable so that the resulting sensitivity characteristics, electrical charge characteristics, and reproducibility are all good. Further, by combination with butadiene compounds for use, the resulting sensitivity characteristics, electrical charge characteristics, and reproducibility are all particularly satisfactory.

In addition to the pigments and dyes listed above, the charge generating layer 5 may contain a chemical sensitizer or an optical sensitizer. Examples of the chemical sensitizer include electron acceptors, for example, cyano compounds such as tetracyanoethylene and 7,7,8,8-tetracyanoquinodimethane, quinones such as anthraquinone and p-benzoquinone, and nitro compounds such as 2,4,7-trinitrofluorenone and 2,4,5,7-tetranitrofluorenone. Examples of the optical sensitizer include colorants such as a xanthene colorant, a thiazine colorant and a triphenylmethane colorant.

The charge generating layer 5 is formed by dispersing the foregoing charge generating substance in an appropriate solvent along with a binder resin, laminating the dispersion on the undercoat layer 4, and drying or curing the laminate. Specific examples of the binder resin include a polyallylate, polyvinyl butyral, a polycarbonate, a polyester, a polystyrene, polyvinyl chloride, a phenoxy resin, an epoxy resin, silicone, a polyacrylate and the like. Examples of the solvent include isopropyl alcohol, cyclohexanone, cyclohexane, toluene, xylene, acetone, methyl ethyl ketone, tetrahydrofuran, dioxane, dioxolane, ethyl cellosolve, ethyl acetate, methyl acetate, dichloromethane, dichloroethane, monochlorobenzene, ethylene glycol dimethyl ether and the like.

The solvent is not limited to the foregoing ones, and may be selected from alcohol, ketone, amide, ester, ether, hydrocarbon, chlorohydrocarbon and aromatic solvents. They may be used either singly or in combination. However, in consideration of the decrease in sensitivity owing to crystal transformation in pulverization and milling of the charge generating substance and the decrease in properties due to pot life, it is preferable to use any of cyclohexanone, 1,2-dimethoxyethane, methyl ethyl ketone and tetrahydroquinone that less cause crystal transformation in inorganic or organic pigments.

A gaseous-phase deposition method such as a vacuum deposition method, a sputtering method or a CVD method, or a coating method can be applied to formation of the charge generating layer 5. In case of using the coating method, a coating solution obtained by pulverizing the charge generating substance with a ball mill, a sand grinder, a paint shaker or an ultrasonic dispersing machine, dispersing the powder in a solvent and adding a binder resin as required is coated on the undercoat layer 4 by a known coating method. When the conductive substrate 3 formed on the undercoat layer 4 is cylindrical, a spraying method, a vertical ring method, a dip-coating method or the like can be used as a coating method. The film thickness of the charge generating layer 5 is preferably from approximately 0.05 to 5 μm, more preferably from approximately 0.1 to 1 μm.

When the conductive substrate 3 formed on the undercoat layer 4 is a sheet, a baker applicator, a bar coater, casting, spin coating or the like can be used in the coating method.

The charge transporting layer 6 can contain a known charge transporting substance and a binder resin. Any charge transporting substance can be used so long as it has an ability to receive charges generated in the charge generating substance contained in the charge generating layer 5 and transport the same. Examples of the charge transporting substance include electron-donating compounds such as poly-N-vinylcarbazole and its derivatives, poly-g-carbazolyl ethylglutamate and its derivatives, polyvinylpyrene, polyvinylphenanthrene, oxazole derivatives, oxadiazole derivatives, imidazole derivatives, 9-(p-diethylaminostyryl)anthracene, 1,1-bis(4-dibenzylaminophenyl)propane, styrylanthracene, styrylpyrazoline, pyrazoline derivatives, phenylhydrazones, hydrazone derivatives, a triphenylamine compound, a tetraphenyldiamine compound, a stilbene compound and an azine compound having a 3-methyl-2-benzothiazoline ring.

As the binder resin constituting the charge transporting layer 6, any binder resin can be used so long as it has compatibility with the charge transporting substance. Examples thereof include a polycarbonate, a copolycarbonate, a polyallylate, polyvinyl butyral, a polyamide, a polyester, an epoxy resin, a polyurethane, a polyketone, a polyvinyl ketone, a polystyrene, polyacrylamide, a phenolicresin, a phenoxyresin, a polysulfone resin and resin copolymers thereof. These resins may be used either singly or in combination. Of these binder resins, resins such as a polystyrene, a polycarbonate, a copolycarbonate, a polyallylate and a polyester have volume resistance of $10^{13}\Omega$ or more, and are excellent in film form ability and potential properties.

As the solvent that dissolves these materials, alcohols such as methanol and ethanol, ketones such as acetone, methyl ethyl ketone and cyclohexanone, ethers such as ethyl ether, tetrahydrofuran, dioxane and dioxolane, halogenated aliphatic hydrocarbons such as chloroform, dichloromethane and dichloroethane and aromatics such as benzene, chlorobenzene and toluene can be used.

The coating solution for forming the charge transporting layer 6 is prepared by dissolving the charge transporting substance in the binder resin solution. The ratio of the charge transporting substance occupied in the charge transporting layer 6 is preferably in the range of from 30 to 80% by weight. The formation of the charge transporting layer 6 on the charge generating layer 5 is performed in the same manner as the formation of the charge generating layer 5 on the undercoat layer 4. The film thickness of the charge transporting layer 6 is preferably from 10 to 50 μm, more preferably from 15 to 40 μm.

The charge transporting layer 6 may contain at least one electron acceptor material or colorant to improve sensitivity and suppress the increase in residual potential or fatigue in repetitive use. Examples of the electron acceptor material include acid anhydrides such as succinic anhydride, maleic anhydride, phthalic anhydride and 4-chloronaphthalic anhydride, cyano compounds such as tetracyanoethylene, terephthalmalondinitrile, aldehydes such as 4-nitrobenzaldehyde, anthraquinones such as anthraquinone and 1-nitroanthraquinone, polycyclic or heterocyclic nitro compounds such as 2,4,7-trinitrofluorenone and 2,4,5,7-tetranitrofluorenone. These can be used as a chemical sensitizer.

Examples of the colorant include organic photoconductive compounds such as a xanthene colorant, a thiazine colorant, a triphenylmethane colorant, a quinoline pigment and copper phthalocyanine. These can be used as an optical sensitizer.

The charge transporting layer 6 may further contain a known plasticizer to improve film formability, flexibility and mechanical strength. Examples of the plasticizer include a dibasic acid ester, a fatty acid ester, a phosphoric ester, a phthalic ester, a chlorinated paraffin, an epoxy-type plasticizer and the like. The photosensitive layer 7 may contain, as required, a leveling agent for preventing a surface condition like orange peel, such as polysiloxane, a phenolic compound for improving durability, an antioxidant such as a hydroquinone compound, a tocopherol compound or an amine compound, an ultraviolet light absorber and the like.

The surface free energy (γ) on the surface of the photoreceptor 2 constructed above, namely, the surface of the photosensitive layer 7 is determined such that the value calculated by the extended Forkes's theory is at least 20 mN/m and at most 35 mN/m, preferably at least 28 mN/m and at most 35 mN/m.

Once the surface free energy exceeds 35 mN/m, the attachment strength of the toner particles is increased with respect to the surface of the electrophotographic photoreceptor, resulting in poorer cleaning performance. When the surface free energy becomes less than 20 mN/m, the attachment strength of the toner particles with respect to the surface of the photoreceptor 2 is reduced. As a result, the toner particles scatter inside of the apparatus, and the fine powder toner attached to parts other than a toner image part on the photoreceptor 2 is transferred to recording paper, thereby causing image fogging. In view thereof, the surface free energy of 20 to 35 mN/m is considered suitable.

The surface free energy on the surface of the photoreceptor 2 is determined within the foregoing range in the following manner. It can be realized by introducing a material having a relatively low surface free energy value, for example, a fluorine-containing material typified by polytetrafluoroethylene (PTFE) or a polysiloxane material into the photosensitive layer 7 and adjusting its content. Further, it can be realized by varying the types of the charge generating substance, the charge transporting substance and the binder resin contained in the photosensitive layer 7 and the composition ratio thereof. Still further, it can be realized by controlling a drying temperature in forming the photosensitive layer 7.

The surface free energy on the surface of the photoreceptor 2 which is determined in this manner is obtained by measuring adhesions with known reagents used as the dipolar component, the dispersion component and the hydrogen-bonding component of the surface free energy. Specifically, contact angles to the surface of the photoreceptor 2 are measured with a contact angle meter CA-X (trade name: manufactured by Kyowa Kaimen K.K.) using pure water, methylene iodide and αx-bromonaphthalene as reagents. The surface free energies of the respective components can be calculated on the basis of the measured results using a surface free energy analysis software EG-11 (trade name: manufactured by Kyowa Kaimen K.K.) Incidentally, the reagents are not limited to the foregoing pure water, methylene iodide and α-bromonaphthalene, and an appropriate combination of reagents can be used as the dipolar component, the dispersion component and the hydrogen-bonding component. The measuring method is not limited to the foregoing method. For example, the Wilhelmy method (hanging plate method) or the Du Nouy method is also available.

Formation of an electrostatic latent image in the photoreceptor 2 is briefly described below. The photosensitive layer 7 formed on the photoreceptor 2 is, for example, negatively charged uniformly with a charging unit. When light having an absorption wavelength is applied to the charge generating layer 5 in the charged state, charges of electrons or holes are generated in the charge generating layer 5. The holes are moved to the surface of the photoreceptor 2 by the charge transporting substance contained in the charge transporting layer 6 to neutralize negative charges of the surface. The electrons in the charge generating layer 5 are moved to the conductive substrate 3 with positive charges induced to neutralize positive charges. Thus, in the photosensitive layer 7, a difference is provided between the charge amount of the exposed site and the charge amount of the unexposed site to form an electrostatic latent image.

Referring back to FIG. 1, described next is the structure of the image forming apparatus 1 provided with the above-described photoreceptor 2, and the image formation operation thereof. The image forming apparatus 1 exemplified in the present embodiment is a digital copying machine 1.

The digital copying machine 1 brief content comprises a scanner portion 11 and a laser recording portion 12. The scanner portion 11 includes an original mounting base 13 made of a transparent glass, a double-side-available automatic original feeder (RADF) 14 for automatically feeding an original to the original mounting base 13 and a scanner unit 15 which is an original image reading unit for scanning and reading an image of the original mounted on the original mounting base 13. The original image read with the scanner portion 11 is sent to an image data input portion as an image data where the image data is subjected to predetermined image treatment. Plural originals are set at a time on an original tray provided on RADF 14, and the originals set are automatically fed to the original mounting base 13 one by one. In order to allow the scanner unit 15 to read one side or both sides of the original according to the operator's selection, RADF 14 includes a transport route for a one-sided original, a transport route for a double-sided original, a transport route switch-over unit, a sensor group for grasping and managing the condition of the original passed through each portion, a control portion and the like.

The scanner unit 15 includes a lamp reflector assembly 16 for exposing the surface of the original, a first scanning unit 18 fitted with a first reflection mirror 17 for reflecting reflected light from the original to lead a reflected light image of the original to a photoelectric conversion device (abbr. a CCD) 23, a second scanning unit 21 fitted with second and third reflection mirrors 19, 20 for leading a reflected light image of the first reflection mirror 17 to the CCD 23, an optical lens 22 for forming an image on the CCD 23 that converts the reflected light image of the original to electric image signals via the foregoing reflection mirrors 17, 19, 20, and the CCD 23.

The scanner portion 11 is adapted to feed and mount the original to be read on the original mounting base 13 by relative operation of RADF 14 and the scanner unit 15 and read the original images upon moving the scanner unit 15 along the lower surface of the original mounting base 13. The first scanning unit 18 is scanned at a fixed rate V in the reading direction of the original images (from left to right toward the paper surface in FIG. 1) along the original mounting base 13, and the second scanning unit 21 is scanned in parallel in the same direction at a half rate (V/2) of the rate V. By the operations of the first and second scanning units 18, 21, the original images mounted on the original mounting base 13 can be formed on the CCD 23 in sequence at every line to read the images.

The image data obtained by reading the original images with the scanner unit 15 are sent to an image treating portion to be described later where they are subjected to various image treatments. The resulting images are then once stored in a memory of the image treating portion, and the images in the memory are read according to output instructions, sent to a laser recording portion 12, and formed on a recording paper as a recording medium.

The laser recording portion 12 has a recording paper transport system 33, a laser writing unit 26 and an electrophotographic processing portion 27 for forming images. The laser writing unit 26 includes image data which are read by the scanning unit 15 and stored in the memory and then read out from the memory, a semiconductor laser source for emitting a laser beam according to the image data sent from an external device, a polygon mirror for polarizing the laser beam at a conformal rate, an f-θ lens for correcting the laser beam polarized at the conformal rate such that it is polarized at the conformal rate on the photoreceptor 2 mounted on the electrophotographic processing portion 27.

In the electrophotographic processing portion 27, a charging unit 28, a developing unit 29 as a developing means, a transfer unit 30 as a transfer means and a cleaning unit 31 as a cleaning means are mounted in this order around the photoreceptor 2 from an upstream side to a downstream side in a rotational direction of the photoreceptor 2 as shown by an arrow 32. As stated above, the photoreceptor 2 is uniformly charged with the charging unit 28, and exposed in the charged state to a laser beam corresponding to the original image data which beam is emitted from the laser writing unit 26. The electrostatic latent images formed on the surface of the photoreceptor 2 by exposure are developed with a toner supplied from the developing unit 29 to form toner images as visible images. The toner images formed on the surface of the photoreceptor 2 are transferred onto a recording paper fed by a transport system 33 to be described later through the transfer unit 30. A transfer unit 30 may be either of corona discharge type or transfer roller type.

A developing unit 29 carrying out image development by providing a static latent image formed on the surface of the photoreceptor 2 with a toner included in a developer is configured to include a casing 29*a*, a stirring roller 29*b* and a developing roller 29*c*, both of which are supported by the casing 29*a* to freely rotate, and a developer 50 stored in the casing 29*a*. The stirring roller 29*b* stirs the developer 50 stored in the casing 29*a*, and transfers the stirred result to the developing roller 29*c*. The developing roller 29*c* provides a toner included in the developer 50 provided by the image stirring roller 29*b* to a static latent image on the surface of the photoreceptor 2.

The developer may be either magnetic or nonmagnetic mono-component developer or two-component developer, and the toner included in the developer is provided to the photoreceptor while making contact therewith or not. In either case, used is the reversal development with which light-radiated electric potential is developed.

In the present embodiment, the developer 50 is of two-component, and includes a toner and a carrier. Described below is the toner included in the developer 50. The toner is manufactured first by thoroughly mixing a bonding resin, a coloring agent, a wax, an electrical charge control agent, and any other types of additives as required using a mixer such as Henschel mixer or super mixer. The resulting mixture is melt and kneaded using a dual-axis kneader to manufacture the kneaded result, and the kneaded result is then crushed using a jet-type crusher. By sizing the kneaded result after crushing, the resulting toner particles can have the adjusted volume average diameter of 4 μm or larger but 7 μm or smaller.

With the volume average diameter of 4 μm or smaller, the toner particles are attached onto the surface of the photoreceptor with the greater strength due to the increased effects on the intermolecular forces resulted from the increased specific surface, thereby lowering the level of the cleaning performance. When the volume average diameter of the toner particles exceeds 7 μm, the coarse toner particles resultantly decrease the image quality. In consideration thereof, the volume average diameter of the toner particles is set to a range of 4 to 7 μm.

The developer 50 is manufactured by adding inorganic particles serving as carriers to the toner manufactured as above, and then by making the toner attach to the carriers and uniformly disperse thereon using a mixer such as Henschel mixer or super mixer.

The bonding resin for use to the toner includes polystyrene, styrene-acrylic copolymer, styrene-acrylonitrile copolymer, styrene-maleic anhydride copolymer, styrene-acrylic-maleic anhydride copolymer, polyvinyl chloride, polyolefin resin, epoxy resin, silicone resin, polyamide resin, polyurethane resin, urethane modified polyester resin, acrylic resin, or others, those of which are to be individually used or mixed for use. Additionally, they are to be used as block polymer or graft polymer. Further, such bonding resins are all allowed for use as long as having a known molecular distribution such as monomodal or bimodal distribution for use with the toner.

In terms of the thermal characteristics of the bonding resin, the one having the glass transition point Tg of 40° C. to 70° C. is suitably used. With the bonding resin having the glass transition point Tg of 40° C. or lower, when the temperature in the apparatus is increased, there is a high possibility that it causes the toner particles to melt and flocculate. With the bonding resin having the glass transition point Tg of 70° C. or more, the fusibility becomes poor, and thus is not practical for use.

The coloring agent includes carbon black, iron black, metal azo dye, any other various oil-soluble dyes and pigments, and others. Desirably, such coloring agents are added by 1 to 10 parts by weight with respect to 100 parts by weight of a resin component.

The wax includes polyethylene, polypropylene, ethylene-propylene copolymer, and polyolefin wax, and desirably, one kind at least selected from this group is added by 1 to 10 parts by weight with respect to 100 parts by weight of a resin component.

As to the electrical charge control agent, there are two types of positive charge control, and negative charge control, and for example, options for use are azo dye, carboxylate metal complex, quaternary ammonium compounds, nigrosine dye, and others. Desirably, such electrical charge control agents are added by 0.1 to 5 parts by weight to 100 parts by weight of a resin component.

The inorganic particles for use as the carriers are exemplified by fine powder including metal oxide particles such as silica, titanium, alumina, magnetite, and ferrite, and metal nitrogen particles such as silicon nitride, and boron nitride. Other options for use include those derived by subjecting such fine powder, on their surfaces, to a silane coupling process such as dimethyldichlorosilane, amilosilane, and others, or a silicone oil process, or those provided with components including fluorine. The results derived as such may be added individually or plurally. Herein, for the inorganic particles for addition, it is preferable to use conductive inorganic particles, specifically magnetite.

A transport system 33 for recording paper is provided with: a transport section 34 for transporting the recording paper to a transfer position at which an electrophotographic process section 27, specifically the transfer unit 30 is placed for image formation; first to third cassette feeding devices 35, 36, and 37 for feeding the recording paper to the transport section 34; a manual feeding device 38 for feeding recording paper of any desired size if required; an image fixation unit 39 for fixing an image, specifically a toner image transferred from the photoreceptor 2 to the recording paper; and a re-feeding path 40 for re-feeding the recording paper for image formation on the underside of the recording paper after the toner image is fixed thereto (the surface opposite to the surface on which the toner image is formed). On the transport path of this transport system 33, a plurality of transport rollers 41 are provided, and the recording paper is transported by these transport rollers 41 to a predetermined position in the transport system 33.

The recording paper through the process of toner image fixation by the image fixation unit 39 is forwarded for supply to the re-feeding path 40 for image formation on its underside, or forwarded for supply to a post-processing device 43 by a paper ejection roller 42. The recording paper forwarded for supply to the re-feeding path 40 is repeatedly subjected to the above-described operation, and an image is formed on its underside. The recording paper forwarded for supply to the post-processing device 43 is first subjected to post processing, and then ejected to either a first or second paper ejection cassette 44 or 45 being a paper-ejection destination determined depending on processes of the post processing. This is the end of a series of image formation operation in the digital copying machine 1.

In the invention, as described in the foregoing, the volume average diameter of the toner particles is set to be small as 4 to 7 μm with the aim of achieving higher quality and higher resolution for the resulting images. The surface free energy (γ) of the photosensitive layer 7 of the photoreceptor 2 to which the toner particles are to be attached is set to low as 20 to 35 mN/m, preferably 28 to 35 mN/m.

As such, although reducing the size of the toner particles increases the effects on the intermolecular forces, the surface free energy on the surface of the photosensitive layer 7 configuring the surface of the photoreceptor 2 is low. The interface free energy between the surface of the photoreceptor 2 and the toner thus falls in a preferable range for the image transfer and cleaning operations. By the interface free energy between the surface of the photoreceptor 2 and the toner falling in a preferable range as such, the toner is easily transferred from the surface of the photoreceptor 2 onto the recording paper, thereby hardly causing the toner particles to be left on the element surface. Even if left, thus left toner particles can be cleaned by the cleaning unit 31 with ease. Thanks to the fact that the remaining toner particles are easily eliminated from the surface of the photoreceptor 2, the cleaning blade of the cleaning unit 31 that is provided for cleaning the surface of the photoreceptor 2 is set low with its abrasion performance, and the abutment pressure of the cleaning blade with respect to the surface of the photoreceptor 2 is also set low, thereby prolonging the useful life of the photoreceptor 2.

As such, it becomes possible to achieve both the higher quality for images and the good cleaning performance for the photoreceptor 2. Thereby, implemented is the image forming apparatus 1 with which the surface of the photoreceptor 2 is always kept clean, and higher-quality images can be stably formed over a long period of time.

As another example of the invention, described now is a toner as a component of the developer 50, which is stored in the developing unit 29 of the digital copying machine 1 serving as an image forming apparatus. The toner is manufactured first by thoroughly mixing a bonding resin, a coloring agent, a wax, an electrical charge control agent, and any other types of additives as required using a mixer such as Henschel mixer or super mixer. The resulting mixture is melt and kneaded using a dual-axis kneader to manufacture the kneaded result, and the kneaded result is then crushed using a jet-type crusher and sized. Thus manufactured toner is then added with inorganic particles for attachment and uniform dispersion using a mixer such as Henschel mixer or super mixer.

The bonding resin for use to the toner includes styrene-acrylic copolymer, acrylic polymer, polyester resin, and others. Among these, suitably used is the polyester resin having the higher design flexibility for the chemical structure of the resin.

The additives for use to the toner include, for example, metal oxide fine powder such as silica fine powder, alumina fine powder, titanium oxide fine powder, zirconium oxide fine powder, magnesium oxide fine powder, zinc oxide, and others, nitride fine powder such as boron nitride fine powder, aluminum nitride fine powder, carbon nitride fine powder, and others, and calcium titanate, strontium titanate, barium titanate, magnesium titanate, and others. Note here that such additives are preferably inorganic fine powder having the average primary diameter of 0.001 to 0.2 μm.

The additives are required not only to enhance the flowability of the toner particles but also not to impair the electrical charge characteristics of the toner. Accordingly, it is considered more preferable if the inorganic fine powder has been subjected to a surface hydrophobic process, and the surface hydrophobic process can satisfactorily provide the toner particles with flowability and stabilize the electrification thereof at the same time. That is, by applying the surface hydrophobic process to the additives, the effects of moisture factors that change the amount of electrical charge can be eliminated, and the amount difference of the electrical charge can be decreased no matter if the humidity is high or low. The environmental characteristics can be thus improved, and by executing the hydrophobic process during the manufacturing process, the primary particles are prevented from flocculating. Accordingly, the toner particles can become uniformly charged.

The agent for the hydrophobic process is selected as appropriate depending on the purpose for surface quality change, e.g., control of the electrical charge characteristics, and depending on the electrical charge stability and reactivity at high humidities. The agent for the hydrophobic process includes organic silane compound such as alkylalkoxysilane, siloxane, silane, silicone oil, and others, and preferably is not decomposed by heat at a reactive process temperature. Preferably, used is the alkylalkoxysilane with volatility such as a coupling agent expressed by the following general formula (4), including both a hydrophobic group and a coupling group that is extremely reactive.

$$RmSiYn \quad (4)$$

[where, in the formula, R denotes an alkoxy group, m denotes an integer of 1 to 3, Y denotes a hydrocarbon group such as an alkyl group, a vinyl group, a glycidoxy group, or a methacrylic group, and n denotes an integer of 1 to 3]

The alkylalkoxysilane expressed by the above general formula includes, for example, vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, n-octadecyltrimethoxysilane, and others.

More preferably, used is the alkylalkoxysilane compound expressed by a formula of $C_aH_{2a+1}$—Si—$(OC_bH_{2b+1})_3$ [where, in the formula, a denotes an integer of 4 to 12, and b denotes an integer of 1 to 3]. Here, when a in the general formula is not larger than 4, the process will be executed with ease but the hydrophobcity may hardly be good. When a exceeds 12, the hydrophobcity may be enough but the powder particles are often united with each other, and thus the capability of flowability provision tends to be lowered. When b exceeds 3, the reactivity is reduced so that the hydrophobcity may hardly be good. In view thereof, a setting is so made that the range for a is 4 to 12, preferably4 to8, and the range for bis 1 to 3, preferably 1 to 2.

At the time when the additives are subjected to the hydrophobic process, the formulation of the agent for the hydrophobic process is 1 to 50 parts by weight, preferably 3 to 45 parts by weight with respect to 100 parts by weight of the silica fine powder serving as the additive, and the hydrophobcity of 30 to 90%, preferably 40 to 80% will do.

The toner may include a mold release agent if required. The mold release agent includes any arbitrary well-known mold release agent, e.g., aliphatic resin, aliphatic metalsalt, higher fatty acid, aliphatic ester, or aliphatic compounds such as partially-saponified compounds. To be specific, the options are low molecular-weight polypropylene, high molecular-weight polyethylene, paraffin wax, low molecular-weight olefin polymer composed by olefin monomer of 4 or more carbon atoms, silicone oil, various waxes, and others.

The coloring agent for use to the toner of the invention is a well-known carbon black, exemplified by REGAL (REGAL) 400R, 500R, and 660R manufactured by Cabot Corp., USA, RAVEN (RAVEN) H20, RAVEN 16, RAVEN 14, RAVEN 430, RAVEN 450, and RAVEN 500 manufactured by Columbian Carbon Japan, Ltd, Printex (Printex) 200, Printex A, Special Black 4, and Printex G manufactured by Degussa, West Germany, and others. Here, the carbon black of the coloring agent is not restrictive thereto, and any other will do. Moreover, such carbon blacks may be used for various compositions individually or by combining two or more of those.

The toner for use in the invention can be manufactured also by crushing. The issue here is that the resulting toner particles derived by such crushing generally tend to vary in shape. Therefore, to derive such physical properties as the average roundness characteristically of 0.95 or more of the toner for use in the invention, it is preferable to go through a mechanical/thermal process, or any other process. As a process method to derive the average roundness of 0.95 or more for the toner, it is preferable to go through a process utilizing the mechanical impact force in consideration of the electrical charge characteristics, the transfer characteristics, and any other image characteristics of the toner particles, and the productivity.

The process method for applying the mechanical impact force is exemplified by applying the mechanical impact force such as compression force and friction force to the toner particles by pressing those inside of a casing utilizing the centrifugal force. Used here are a mechanical-impact-type crusher such as a kryptron system manufactured by Kawasaki Heavy Industries, Ltd., a turbo mill manufactured by Turbo Kogyo Co., Ltd., or a mechano fusion system manufactured by Hosokawa Micron Corp., for example. The average roundness can be adjusted for the toner by changing the processing time utilizing the mechanical impact force as such.

Alternatively, the toner having the average roundness of 0.95 or more may be manufactured by polymerization. The polymerization may be exemplified by a method of suspending, in water, the toner formation composition including the vinyl monomer or others. In this case, a setting is so made that the concentration of the toner formation composition in the suspension solution is 1 to 50% by weight, and the size of the suspended particles is 1 to 30 μm.

In order to stabilize the suspension state of the toner formation composition, a dispersion stabilizer may be added. The dispersion stabilizer is exemplified by a polymeric material soluble into a medium, e.g., polyvinyl alcohol, methylcellulose, ethyl cellulose, polyacrylic acid, polyacrylamide, polyethylene oxide, poly (hydroxy stearic acid-g-methyl methacrylate-CO-methacrylic acid) copolymer, nonionic or ionic surface active agent, inorganic powder such as calcium phosphate, and others. The disperse stabilizer is preferably added by 0.1 to 10% by weight to the entire toner formation composition.

In the toner formation composition, the amount of a radical polymerization starting agent is 0.3 to 30% by weight, preferably 0.5 to 10% by weight with respect to a monomer. At the time of polymerization, the reaction system is filled with the nitrogen gas, and the toner formation composition in the suspension solution is stirred under the environmental temperature of 40 to 100° C. for polymerization while being in the suspension state. Thus generated particles as a result of polymerization after reaction are filtered, purified by water or any appropriate solvent, and dried so that the toner is manufactured.

The toner manufactured by the process of applying the mechanical impact force or polymerization is preferably added with a flowability enhancement agent (surface treatment agent) to enhance the flowability of the particles. The flowability enhancement agent includes, for example, carbon black, hydrophobic amorphous silica, hydrophobic powder alumina, very-fine titanium oxide particles, very-fine spherical resin, and others. In the present embodiment, the flowability enhancement agent is added for attachment to the toner particles, and the resulting toner is used for image development. The flowability enhancement agent may be added to the entire toner by 0.1 to 3.0% by weight.

The roundness (ai) of the toner particles in this specification is defined by the following equation (5). Such a roundness (ai) as defined by the equation (5) is measured by using a flow particle image analyzer "FPIA-2000" manufactured by Toa Medical Electronics Co., Ltd., for example. The roundness (ai) measured form toner particles are summed together, and the arithmetic average value calculated by an equation (6), i.e., dividing the sum by the number of toner particles m, is defined as the average roundness (a).

$$\text{Roundness}(ai) = \frac{\text{Periphera Length of Circle Having the Same Projection Area as Particle Image}}{\text{Periphera Length of Projection Image of Particle}} \quad (5)$$

$$\text{Average Roundness}(ai) = \sum_{i=1}^{m} ai/m \quad (6)$$

Moreover, the roundness of 0.40 to 1.00 is subjected to 61-segmentation by 0.01. The measured roundness (ai) of the respective toner particles is then assigned to each segmentation range. In this manner, the roundness showing the maximum frequency in the frequency distribution of the resulting roundness (ai) is defined as mode roundness (am).

Note here that in the present embodiment using the above-described measurement device "FPIA-2000", a simple calculation method is used. That is, after the roundness (ai) is calculated for the respective particles, the resulting roundness (ai) for the respective toner particles is assigned to the segmentation range as a result of 61-segmentation of the roundness of 0.40to 1.00 so that the frequency is calculated. The center value and the frequency in the respective segmentation ranges are used to calculate the average roundness. Although the value of the average roundness calculated by this simple calculation method has an error from the value of the average roundness (a) derived by the above-described equation (6), it is very small and practically negligible. Therefore, in the present embodiment, the average roundness derived by the simple calculation method is dealt as the average roundness (a) defined by the above-described equation (6). As such, in the present embodiment, used is the simple calculation method in view of shortening the calculation time or others. However, using such a simple calculation method is not departing from the scope of the invention.

The average roundness (ai) and the mode roundness (am) are measured specifically as below. That is, about 0.1 mg of surface active agent is dissolved into 10 mL of water, and thereinto, a developer of 5 mg is dispersed to derive a dispersion solution. The dispersion solution is then exposed to ultrasonic wave of 20 kHz frequency and 50 W output for 5 minutes. Assuming that the concentration of the toner particles in the dispersion solution is 5000 to 20000 pieces/μL, the above-described device "FPIA-2000" is used to measure the roundness (ai). In this manner, the average roundness (a) and the mode roundness (am) are calculated.

The toner is so set as to have the average roundness of 0.95 or more. Thus, the toner particles become uniformly charged to a further extent, favorably leading to higher-quality higher-resolution images. At the time of image development, because the surface free energy (γ) of the photoreceptor 2 to which the toner particles are attached at the time of image development but detached there from at the time of image transfer and cleaning is set to the preferable range of 20 to 35 mN/m, the attachment strength of the toner is controlled to be of the level needed for image development while suppressing excessive attachment strength. As such, when a toner image formed on the surface of the photoreceptor 2 is transferred to a transfer material, the transfer efficiency is increased so that the amount of toner particles to be left on the element surface is controlled, and the remaining toner particles can be easily scraped using a cleaning blade at the time of cleaning. In this manner, realized is the good cleaning performance.

As such, by defining the average roundness of the toner particles and the surface free energy (γ) on the surface of the photoreceptor 2 to be both in a preferable range, implemented is an image forming apparatus that shows good transfer efficiency and satisfactory cleaning performance even if toner particles in use are spherical with higher average roundness, and is capable of stably forming higher-quality higher-resolution images over a long period of time.

In still another example of the invention, described next is a toner as a component of the developer 50, which is stored in the developing unit 29 of the digital copying machine 1 serving as an image forming apparatus. The toner is manufactured first by thoroughly mixing a bonding resin, a coloring agent, a wax, an electrical charge control agent, and any other types of additives as required using a mixer such as Henschel mixer or super mixer. The resulting mixture is melt and kneaded using a dual-axis kneader to manufacture the kneaded result, and the kneaded result is then crushed using a jet-type crusher. By sizing the kneaded result after crushing, the resulting toner particles can have the adjusted volume average diameter of 4 to 7 μm. Thus manufactured toner is then added with inorganic particles for attachment and uniform dispersion using a mixer such as Henschel mixer or super mixer. The volume average diameter of the toner particles manufactured as such can be measured by a multisizer measurement device (manufactured by Coulter K.K.) for example.

The bonding resin for use to the toner includes polystyrene, styrene-acrylic copolymer, styrene-acrylonitrile copolymer, styrene-maleic anhydride copolymer, styrene-acrylic-maleic anhydride copolymer, polyvinyl chloride, polyolefin resin, epoxy resin, silicone resin, polyamide resin, polyurethane resin, urethane modified polyester resin, acrylic resin, or others, those of which are to be individually used or mixed for use. Additionally, they are to be used as block polymer or graft polymer. Further, such bonding resins are all allowed for use as long as having a known molecular distribution such as monomodal or bimodal distribution for use with the toner.

In terms of the thermal characteristics of the bonding resin, the one having the glass transition point Tg of 40° C. to 70° C. is suitably used. With the bonding resin having the glass transition point Tg of 40° C. or lower, when the temperature in the apparatus is increased, there is a high possibility that it causes the toner particles to melt and flocculate. With the bonding resin having the glass transition point of 70° C. or more, the fusibility becomes poor, and thus is not practical for use.

The coloring agent includes carbon black, iron black, metal azo dye, any other various oil-soluble dyes and pigments, and others. Desirably, such coloring agents are added by 1 to 10 parts by weight with respect to 100 parts by weight of a resin component.

The wax includes polyethylene, polypropylene, ethylene-propylene copolymer, and polyolefin wax, and desirably, one kind at least selected from this group is added by 1 to 10 parts by weight with respect to 100 parts by weight of a resin component.

As to the electrical charge control agent, there are two types of positive charge control and negative charge control, and for example, options for use are azo dye, carboxylate metal complex, quaternary ammonium compound, nigrosine dye, and others. Desirably, such electrical charge control agents are added by 0.1 to 5 parts by weight with respect to 100 parts by weight of a resin component.

For the purpose of providing the resulting toner with the capability of flowability, abrasivity and the like, organic and/or inorganic fine powder may be dispersed and added to the toner. The addition amount of the fine powder may be 0.3 to 5 parts by weight with respect to 100 parts by weight of the toner. The organic fine powder includes, for example, acrylic resin, polyester resin, fluorocarbon resin, styrene plastic, or others. The inorganic fine powder includes, for example, silica fine powder, titanium oxide fine powder, alumina fine powder, and others. Specifically, through addition of inorganic fine powder having the specific surface of 90 to 150 $m^2/g$ by nitrogen absorption measured by BET, the result will be satisfactory.

Alternatively, for the purpose of controlling the hydrophobic performance and the electrical charge characteristics, as appropriate, the inorganic fine powder may be processed by a treatment agent such as silicone varnish, various types of silicone varnish, silicone oil, various types of modified silicone oil, silane coupling agent, silane coupling agent with functional group, any other organosilicon compounds, or others. Especially, the silica fine powder having been subjected to surface treatment using the silicone oil is preferable.

Other preferable options for additives include a lubricant such as PTFE, zinc stearate, polyvinylidene fluoride, silicone oil particles (about 40% silica included), and others. The preferable options for abrasives include ceric oxide, silicon carbide, calcium titanium, strontium titanate, and others, and especially the strontium titanate is preferable.

Still alternatively, a conductivity provision agent such as carbon black, zinc oxide, antimony oxide, tin oxide, and others may be used only a small amount as an agent for enhancing the developing characteristics of white fine particle and black fine particle, both of which have the polarity reverse to that of the toner particles.

The electrostatic latent image formed on the photosensitive layer 7 of the photoreceptor 2 is developed using magnetic or nonmagnetic mono-component developer or two-component developer including the toner manufactured as above while making contact therewith or not. In either case, used is the reversal development with which light-radiated electric potential is developed.

In a case with a mono-component developer, the toner manufactured as above may be used as it is as a nonmagnetic mono-component developer. Generally, magnetic particles of about 0.1 to 5 μm may be included in the toner particles, and the result is used as a magnetic mono-component developer. In a case with a two-component developer, carriers configured by iron powder, ferrite, magnetite, resin bead, and others are mixed to the toner with any desired mixture ratio. The volume average diameter of the carrier particles for mixture as such is preferably in a range of 40 to 100 μm, and more preferably, in a range of 50 to 80 μm. The particle size smaller than 40 μm frequently causes carrier hops, thereby making inside of the apparatus dirty as a result of carrier scattering, and damaging the photoreceptor. On the other hand, the particle size exceeding 100 μm hardens tips of the developer, damaging the photoreceptor to a greater degree. This thus causes abrasion of the photosensitive layer to a greater extent, shortening the useful life of the photoreceptor.

To exercise control over the toner particles to have the average amount of electrical charge of 10 to 30 μC/g, the electrical charge control agent may be changed in type or amount. In a case with a two-component developer, a coating material of carrier particles may be changed in type or coating amount for mixture to the developer. The average amount of electrical charge of this toner is measured in the following manner, for example. That is, a developer including carriers and a toner mixed together with a toner concentration of B% is weighed and sampled by Cg (about 0.2g) for measurement using a Blow-Off TB-200 (manufactured by Toshiba Chemical K.K.). The blow-off pressure used for measurement is assumed to be 1.0 kg/cm$^2$, and the average amount of electrical charge is calculated by the following equation (7) in which a blow-off value after 30 seconds is A.

$$\text{Average Amount of Electrical Charge } (\mu C/g) = A \times 100/(B \times C) \quad (7)$$

Described below is the reason why the average amount of electrical charge of the toner is limited to be in a specific range. When the average amount of electrical charge of the toner is less than 10 μC/g, the electro static attachment strength between the toner and the surface of the photoreceptor 2 is reduced, and thus the toner particles on the surface of the photoreceptor 2 become easily scattered. As a result, image failures are to be observed frequently, e.g., the background fogging is often caused, and the underside of the recording paper gets dirty. On the other hand, when the average amount of electrical charge of the toner exceeds 30 μC/g, the electrostatic attachment strength between the toner and the surface of the photoreceptor 2 becomes too large, and thus the toner becomes difficult to be eliminated from the surface of the photoreceptor 2, causing poor cleaning performance. In view thereof, the average amount of electrical charge is set to a range of 10 to 30 μC/g for the toner.

As such, with the digital copying machine 1 in which the surface free energy (γ) of the photoreceptor 2 and the average amount of electrical charge of the toner are both set to be in a preferable range, the attachment strength is controlled to be of the level needed for image development while suppressing excessive attachment strength between the photoreceptor 2 and the toner. Therefore, the remaining toner particles can be easily scraped using a cleaning blade, realizing good cleaning performance. Thus implemented is an image forming apparatus that shows good cleaning performance, and is capable of stably forming high-quality high-resolution images over a long period of time.

In still another example of the invention, after a toner image is transferred onto a recording paper in the above-described manner, the photoreceptor 2 continues to rotate in the direction of an arrow 32, and slides in contact with a cleaning blade 31*a* provided to the cleaning unit 31 so that the element surface is cleaned by the cleaning blade 31*a* passing thereover. Such a cleaning process is for eliminating any residual toner particles left on the surface of the photoreceptor 2 after a toner image on the photoreceptor 2 is transferred onto recording paper using the transfer unit 30.

The material of the cleaning blade 31*a* provided to the cleaning unit 31 is required, generally, (1) not to make the photo receptor dirty or damage, (2) to be satisfactorily abrasive resistant, (3) not to cause compression/permanent tensile distortion too much, and the like. To such a material of the cleaning blade 31*a*, a rubber elastic body is suitably used. The rubber elastic body includes the one with the rubber elasticity, e.g., polyurethane rubber, silicone rubber, nitrile rubber, chloroprene rubber, and the like, and among all, the polyurethane rubber is considered preferable in view of abrasive resistance and permanent deformation. Moreover, a two-part thermosetting polyurethane rubber material is more preferable in consideration of its low permanent deformation. A curing agent for use with the polyurethane rubber can be a general urethane curing agent, including 1,4-butanediol, 1,6-hexanediol, hydrochinone diethylether, bisphenol A, trimethylolpropane, trimethylolethane, and the like.

Note here that the cleaning blade 31*a* may be configured by a single kind of rubber elastic body, or alternatively, a preformed rubber elastic body may be attached, at its tip, with a separately-formed rubber elastic body as an abutment member for the photoreceptor. With respect to the rotation direction 32 of the photoreceptor 2, the cleaning blade 31*a* may abut on the photoreceptor 2 in either the forward direction or the counter direction. However, the counter direction is more preferable because of its higher cleaning performance and higher filming elimination performance.

As to the cleaning blade 31*a* of the cleaning unit 31 provided as such, the line voltage thereof abutting on the photoreceptor 2 is set to be 10 gf/cm ($0.98\times10^{-1}$ N/cm) or more but 35 gf/cm ($3.43\times10^{-1}$ N/cm) or less. When the line voltage is less than 10 gf/cm, the residual toner particles left on the surface of the photoreceptor cannot be scraped without being transferred to the recording paper, causing poor cleaning of fogging on the resulting image. On the other hand, when the line voltage exceeds 35 gf/cm, the cleaning performance can be satisfactory but the useful life of the photoreceptor is shortened, and the maintenance cost is increased. This is because the surface of the photoreceptor suffers from abrasion at the time of cleaning, thereby thinning the film of the photoreceptor to a greater degree. In view thereof, the line voltage of the cleaning blade 31*a* with respect to the photoreceptor 2 is set to be 10 gf/cm or more but 35 gf/cm or less.

Described next is a toner as a component of the developer 50, which is a characteristic of the image forming apparatus 1 of the invention, and is stored in the developing unit 29 of the digital copying machine 1 serving as an image forming apparatus. The toner is manufactured first by thoroughly mixing a bonding resin, a coloring agent, a wax, an electrical charge control agent, and any other types of additives as required using a mixer such as Henschel mixer or super mixer. The resulting mixture is melt and kneaded using a dual-axis kneader to manufacture the kneaded result, and the kneaded result is then crushed using a jet-type crusher and sized. Thus manufactured toner is then added with inorganic particles for attachment and uniform dispersion using a mixer such as Henschel mixer or super mixer.

The bonding resin for use to the toner includes styrene-acrylic copolymer, acrylic polymer, polyester resin, and others. Among these, suitably used is the polyester resin having the higher design flexibility for the chemical structure of the resin.

The toner fusible at low temperature is characteristically required to be fusible enough at low fusing temperature and good in hot offset. The hot offset phenomenon is a phenomenon occurring in the image fixation process. That is, when the surface of a heat roller directly abuts on a transferred toner image, and when a toner is melted and fused onto recording paper or others by the heat and pressure provided by the heat roller, the toner image is partially attached and transferred to the surface of the heat roller, and the transfer result is transferred again onto the next recording paper or others for image fixation. When such a hot offset phenomenon occurs, the image formed on the recording paper suffers from fogging.

For long-time storage, the toner is also required to be stable for storage, being free from particle flocculation. For the purpose of manufacturing a toner fusible at low temperature, two types of bonding resin are used. One is a bonding resin of higher molecular weight for increasing the hot offset characteristics and the storage stability, and the other is a bonding resin of lower molecular weight for achieving low-temperature fusibility. The bonding resin of higher molecular weight and the bonding resin of lower molecular weight are in charge of each separate function. For example, a possible bonding resin may have bimodal molecular distribution, i.e., a part of higher molecular weight and a part of lower molecular weight of a resin of the same composition. As another option, a bonding resin of each different composition may be used for the part of higher molecular weight and the part of lower molecular weight. In the latter case, it is possible to use a bonding resin of the chemical structure varying in composition between the part of lower molecular weight and the part of higher molecular weight, and thus the flexibility is increased for material selection.

The coloring agent for use to the toner is a well-known carbon black, exemplified by REGAL (REGAL) 400R, 500R, and 660R manufactured by Cabot Corp., USA, RAVEN (RAVEN) H20, RAVEN 16, RAVEN 14, RAVEN 430, RAVEN 450, and RAVEN 500 manufactured by Columbian Carbon Japan, Ltd., Printex (Printex) 200, Printex A, Special Black 4, and Printex G manufactured by Degussa, West Germany, and others.

Here, the carbon black of the coloring agent is not restrictive thereto, and any other will do. Moreover, such carbon blacks may be used for various compositions individually or by combining two or more of those.

The additives for use to the toner include, for example, metal oxide fine powder such as silica fine powder, alumina fine powder, titanium oxide fine powder, zirconium oxide fine powder, magnesium oxide fine powder, zinc oxide, and others, nitride fine powder such as boron nitride fine powder, aluminum nitride fine powder, carbon nitride fine powder, and others, and calcium titanate, strontium titanate, barium titanate, magnesium titanate, and others. Note here that such additives are preferably inorganic powder having the average primary diameter of 0.001 to 0.2 μm.

The additives are required not only to enhance the flowability of the toner particles but also not to impair the electrical charge characteristics of the toner. Accordingly, it is considered more preferable if the inorganic fine powder has been subjected to a surface hydrophobic process, and the surface hydrophobic process can satisfactorily provide the toner particles with flowability and stabilize the electrification thereof at the same time. That is, by applying the surface hydrophobic process to the additives, the effects of moisture factors that change the amount of electrical charge can be eliminated, and the amount difference of the electrical charge can be decreased no matter if the humidity is high or low. The environmental characteristics can be thus improved, and by executing the hydrophobic process during the manufacturing process, the primary particles are prevented from flocculating. Accordingly, the toner particles can become uniformly charged.

The toner may include a mold release agent if required. The mold release agent includes any arbitrary well-known mold release agent, e.g., aliphatic resin, aliphatic metalsalt, higher fatty acid, aliphatic ester, or aliphatic compounds such as partially-saponified compounds. To be specific, the options are low molecular-weight polypropylene, high molecular-weight polyethylene, paraffin wax, low molecular-weight olefin polymer composed by olefin monomer of 4 or more carbon atoms, silicone oil, various waxes, and others.

As to the low-temperature fusing toner required to have such characteristics as above, the glass transition temperature (hereinafter, referred to as Tg) is so set as to exceed 20° C. but lower than 60° C. When Tg of the toner is 20° C. or lower, it may cause particle flocculation while the toner is stirred in a developer tank, or lower the storage stability of the toner. When Tg of the toner is 60° C. or higher, the fusing temperature is not lowered, and thus no energy saving is achieved entirely in the copying machine and the printer. In view thereof, Tg of the toner is so set as to exceed 20° C. but lower than 60° C.

Herein, Tg is calculated as below. Using a differential scanning calorimeter (manufactured by SEIKO instruments Inc, DSC210), a measurement is carried out in such a manner that a sample is increased in temperature up to 200° C., and then is cooled from 200° C. down to 0° C. at temperature-reduction speed of 10° C./minute. Then, the sample is increased in temperature again at temperature-increase speed of 10° C./minute. The measurement sample is weighed by 10 mg with accuracy, and the weighed result is put in an aluminum pan. As a reference, used here is an empty aluminum pan. As to Tg, using the chart derived by the measurement carried out as above, derived is the temperature at an intersection of a line extending from a base line less than Tg, and a normal of the maximum slope from a peak rising point to a peak, and thus derived temperature is regarded as Tg.

The toner for use in the invention can be manufactured also by crushing. The issue here is that the resulting toner particles derived by such crushing generally tend to vary in shape. Therefore, it is preferable to go through a mechanical/thermal process, or any other process to increase the roundness. As a process to increase the roundness of the toner particle, it is preferable to go through a process utilizing the mechanical impact force in consideration of the electrical charge characteristics, the transfer characteristics, and any other image characteristics of the toner particles, and the productivity.

The process method for applying the mechanical impact force is exemplified by applying the mechanical impact force such as compression force and friction force to the toner particles by pressing those inside of a casing utilizing the centrifugal force. Used here are a mechanical-impact-type crusher such as a kryptron system manufactured by Kawasaki Heavy Industries, Ltd., a turbo mill manufactured by Turbo Kogyo Co., Ltd., or a mechano fusion system manufactured by Hosokawa Micron Corp., for example. Although the toner particles as a result of crushing are irregular in shape, by going through post processing as such, the toner particles can be round off so that the roundness can be increased. In such a process of applying the mechanical impact force, the toner particles can be of any arbitrary average roundness through adjustment of the processing time or of the toner concentration or others in the apparatus in process.

Alternatively, the toner having the higher average roundness may be manufactured by polymerization. The polymerization may be exemplified by a method of suspending, in water, the toner formation composition including the vinyl monomer or others. In this case, a setting is so made that the concentration of the toner formation composition in the suspension solution is 1 to 50% by weight, and the size of the suspended particles is 1 to 30μm.

In order to stabilize the suspension state of the toner formation composition, a dispersion stabilizer may be added. The dispersion stabilizer is exemplified by a polymeric material soluble into a medium, e.g., polyvinyl alcohol, methylcellulose, ethyl cellulose, polyacrylic acid, polyacrylamide, polyethylene oxide, poly (hydroxy stearic acid-g-methyl methacrylate-CO-methacrylic acid) copolymer, nonionicorionic surface active agent, inorganic powder such as calcium phosphate, or others. The disperse stabilizer is preferably added by 0.1 to 10% by weight to the entire toner formation composition.

In the toner formation composition, the amount of a radical polymerization starting agent is 0.3 to 30% by weight, preferably 0.5 to 10% by weight with respect to a monomer. At the time of polymerization, the reaction system is filled with the nitrogen gas, and the toner formation composition in the suspension solution is stirred under the environmental temperature of 40 to 100° C. for polymerization while being in the suspension state. Thus generated particles as a result of polymerization after reaction are filtered, purified by water or any appropriate solvent, and dried so that the toner is manufactured.

The toner manufactured by the process of applying the mechanical impact force or polymerization is preferably added with a flowability enhancement agent (surface treatment agent) to enhance the flowability of the particles. The flowability enhancement agent includes, for example, carbon black, hydrophobic amorphous silica, hydrophobic powder alumina, very-fine titanium oxide particles, very-fine spherical resin, and others. In the present embodiment, the flowability enhancement agent is added for attachment to the toner particles, and the resulting toner is used for image development. The flowability enhancement agent may be added to the entire toner by 0.1 to 3.0% by weight.

The roundness (ai) of the toner particles in this description is defined by the above-described equation (5). The roundness (ai) measured for m toner particles are summed together, and the arithmetic average value calculated by the equation (6), i.e., dividing the sum by the number of toner particles m, is defined as the average roundness (a).

The preferable range of the average roundness (a) for the toner particles is 0.950 or more. With the average roundness of 0.950 or more, the toner particles become uniformly charged, and the resulting images can be formed with higher quality and higher resolution. As to γ of the photoreceptor 2 to which the toner particles are attached at the time of image development but detached therefrom at the time of image transfer and cleaning is set to the preferable range of 20 to 35 mN/m. Thus, the attachment strength thereof with respect to the toner is controlled to be of the level needed for image development while suppressing excessive attachment strength. As such, when a toner image formed on the surface of the photoreceptor 2 is transferred to a transfer material, the transfer efficiency is increased so that the amount of toner particles to be left on the element surface is controlled, and the remaining toner particles can be easily scraped using a cleaning blade at the time of cleaning. In this manner, realized is the good cleaning performance.

As such, by defining the average roundness (a) of the toner particles and γ on the surface of the photoreceptor 2 to be both in a preferable range, implemented is an image forming apparatus that shows good transfer efficiency and cleaning performance even if toner particles in use are spherical with higher average roundness (a), and is capable of stably forming higher-quality higher-resolution images over a long period of time.

Figure 3:
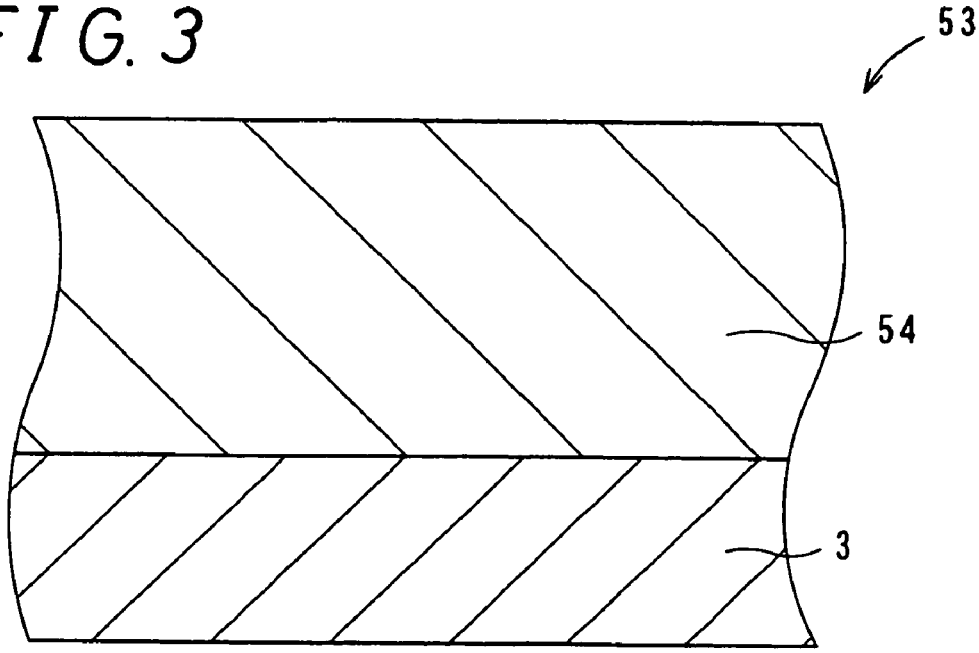
FIG. 3 is a partial cross sectional view showing the simplified structure of a photoreceptor 53 provided to an image forming apparatus according to a second embodiment of the invention.

FIG. 3 is a partial cross sectional view showing the simplified structure of a photoreceptor 53 that is provided to an image forming apparatus according to a second embodiment of the invention. The photoreceptor 53 provided to the image forming apparatus of the present embodiment is similar to the photoreceptor 2 provided to the image forming apparatus 1 of the first embodiment. Any components corresponding there to are provided with the same reference numerals, and not described again. As to the photoreceptor 53, it is noteworthy that a photosensitive layer 54 is singly formed on the conductive support 3.

The photosensitive layer 54 is formed using the same charge generating substance, charge transporting substance and binder resin as used in the photoreceptor 2 according to the first embodiment. The photosensitive layer composed of the single layer is formed on the conductive substrate 3 by the same method in which the charge generating layer 5 in the photoreceptor 2 according to the first embodiment of the invention is formed using a coating solution for a photosensitive layer prepared by dispersing the charge generating substance and the charge transporting substance into the binder resin or dispersing the charge generating substance in the photosensitive layer containing the charge transporting substance in the form of pigment grains. The single-layer photoreceptor 53 of this embodiment is appropriate as a photoreceptor for a positively charged image forming apparatus with less ozone generation, and the photosensitive layer 54 to be coated is only one layer. Accordingly, it is excellent in production cost and yield in comparison to the laminated photosensitive layer formed by laminating the charge generating layer and the charge transporting layer.

FIRST EXAMPLE

Described below are examples of the invention. Note here that the invention is not restrictive to the examples to be described now.

First, photoreceptors in Examples and Comparative Examples which were prepared by forming a photosensitive layer on an aluminum conductive substrate having a diameter of 30 mm and a length of 326.3 under various conditions are described below.

(S1 to S6 Photoreceptors of Examples)

(S1 Photoreceptor); 7 parts by weight of titanium oxide (TTO55A: manufactured by Ishihara Sangyo. Co., Ltd), and 13 parts by weight of copolymer nylon (CM8000: manufactured by Toray Industries) are added to a mixture solution, including 159 parts by weight of methyl alcohol and 106 parts by weight of 1,3-dioxolane. The result is then subjected to a dispersion process for 8 hours using a paint shaker so that a coating solution is formulated for a lower layer. Thus formulated coating solution is filled in a coating bath, and a conductive support is dipped therein and then pulled up. The support is then air-dried so that a lower layer having the thickness of 1 μm is formed.

Three parts by weight of oxotitanylphthalocyanine and 2 parts by weight of a butyral resin (BL-1: manufactured by Sekisui Chemical Co., Ltd.) were mixed with 245 parts by weight of methyl ethyl ketone, and dispersed with a paint shaker to prepare a coating solution for a charge generating layer. This coating solution was coated on the undercoat layer by the same dip-coating method as in the undercoat layer, and dried with air to form a charge generating layer having a thickness of 0.4 μm.

Five parts by weight of a styryl compound represented by the following structural formula (I) as a charge transporting substance, 2.75 parts by weight of a polyester resin (Vylon 290: manufactured by Toyobo Co., Ltd.), 5.25 parts by weight of a polycarbonate resin (G400: manufactured by Idemitsu Petrochemical Co., Ltd.) and 0.05 part by weight of Sumilizer BHT (manufactured by Sumitomo Chemical Co., Ltd.) were mixed, and 47 parts by weight of tetrahydrofuran was used as a solvent to prepare a coating solution for a charge transporting layer. This coating solution was coated on the charge generating layer by a dip-coating method, and dried at 110° C. for 1 hour to form a charge transporting layer having a thickness of 28 μm. In this manner, the S1 photoreceptor S1 was produced.

(I)

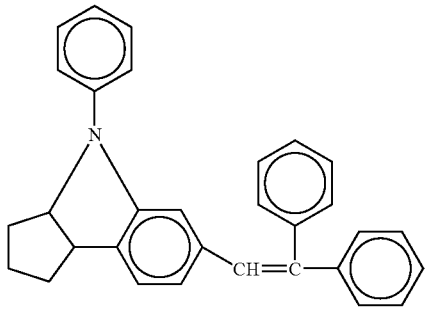

(S2 Photoreceptor); An undercoat layer and a charge generating layer were formed as in the S1 photoreceptor. Subsequently, 5 parts by weight of a butadiene compound represented by the following structural formula (II) as a charge transporting substance, four types of polycarbonate resins, 2.4 parts by weight of J500 (manufactured by Idemitsu Petrochemical Co., Ltd.), 1.6 parts by weight of G400 (manufactured by Idemitsu Petrochemical Co., Ltd.), 1.6 parts by weight of GH503 (manufactured by Idemitsu Petrochemical Co., Ltd.) and 2.4 parts by weight of TS2020 (manufactured by Teijin Kasei K. K.), and 0.25 part by weight of Sumilizer BHT (manufactured by Sumitomo Chemical Co., Ltd.) were mixed, and 49 parts by weight of tetrahydrofuran was used as a solvent to prepare a coating solution for a charge transporting layer. This coating solution was coated on a charge generating layer by a dip-coating method, and dried at 130° C. for 1 hour to form a charge transporting layer having a thickness of 28 μm. In this manner, anS2 photoreceptor was produced.

(II)

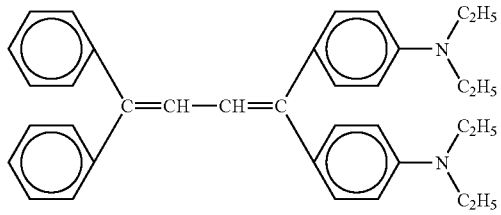

(S3 Photoreceptor); At the time of forming a charge transporting layer, an S3 photoreceptor is manufactured in a similar manner to the S2 photoreceptor, except that a binder resin is 4 parts by weight of GH503 (manufactured by Idemitsu Kosan Co., Ltd.) and 4 parts by weight of TS2020 (manufactured by Teijin Chemicals. Ltd).

(S4 Photoreceptor); An undercoat layer and a charge generating layer were formed as in the S1 photoreceptor. Subsequently, 3.5 parts by weight of the butadiene compound represented by the structural formula (II) as a charge transporting substance, 1.5parts by weight of a styryl compound represented by the following structural formula (III), four types of polycarbonate resins, 2.2 parts by weight of J500 (manufactured by Idemitsu Petrochemical Co., Ltd.), 2.2 parts by weight of G400 (manufactured by Idemitsu Petrochemical Co., Ltd.), 1.8 parts by weight of GH503 (manufactured by Idemitsu Petrochemical Co., Ltd.) and 1.8 parts by weight of TS2020 (manufactured by Teijin Kasei K.K.), and 1.5 part by weight of Sumilizer BHT (manufactured by Sumitomo Chemical Co., Ltd.) were mixed, and 55 parts by weight of tetrahydrofuran was used as a solvent to prepare a coating solution for a charge transporting layer. This coating solution was coated on a charge generating layer by a dip-coating method, and dried at 120° C. for 1 hour to form a charge transporting layer having a thickness of 28 μm. In this manner, the S4 photoreceptor was produced.

(III)

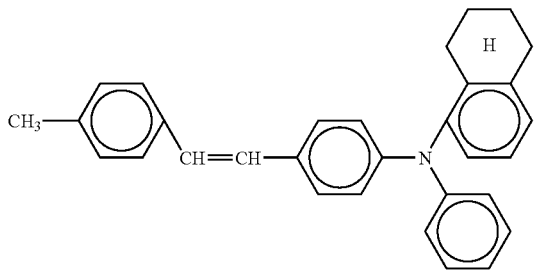

(S5 and S6 Photoreceptors); An undercoat layer and a charge generating layer were formed as in the S1 photoreceptor. Subsequently, a coating solution was prepared as in the S2 photoreceptor except that polytetrafluoroethylene (PTFE), a resin having a low surface free energy (γ) was used in place of a part of polycarbonate resins in forming a charge transporting layer. This coating solution was coated on the charge generating layer by a dip-coating method, and dried at 120° C. for 1 hour to form a charge transporting layer having a thickness of 28 μm. The photoreceptors were produced respectively such that the content of PTFE occupied in the coating solution for forming a charge transporting layer was higher in an S6 photoreceptor than in an S5 photoreceptor and γ of the photoreceptor in the S6 photoreceptor was lower than γ of the photoreceptor in the S5 photoreceptor.

(R1 to R4 Photoreceptors of Comparative Examples)

(R1 Photoreceptor); In a similar manner to the S1 photoreceptor of the first embodiment, a lower layer and an charge generating layer are formed. Thereafter, a coating solution for a charge transporting layer is formulated by mixing 5 parts by weight of butadiene compound expressed by the above-described structural formula (II) as a charge transporting substance, two types of polycarbonate resin, i.e., 2.4 parts by weight of G400 (manufactured by Idemitsu Kosan Co., Ltd.), and 4 parts by weight of TS2020 (manufactured by Teijin Chemicals. Ltd.), 1.6 parts by weight of polyester resin Vylon290 (manufactured by Toyobo Co., Ltd.), and 0.25 part by weight of Sumilizer BHT (manufactured by Sumitomo Chemical Co. Ltd.). Herein, 49 parts by weight of tetrahydrofuran is used as solvent. The resulting coating solution is coated on the charge generating layer by immersion coating, and then the coated result is dried at 130° C. for 1 hour so that a charge transporting layer having the layer thickness of 28 μm is formed. In such a manner, an R1 photoreceptor is manufactured.

(R2 Photoreceptor); In a similar manner to the R1 photoreceptor, a lower layer and a charge generating layer are formed. Thereafter, a coating solution for a charge transporting layer is formulated by mixing 5 parts by weight of butadiene compound expressed by the above-described structural formula (II) as a charge transporting substance, two types of polycarbonate resin, i.e., 4.4 parts by weight of J500 (manufactured by Idemitsu Kosan Co., Ltd.), and 3.6 parts by weight of TS2020 (manufactured by Teijin Chemicals Ltd.), and 0.25 part by weight of Sumilizer BHT (manufactured by Sumitomo Chemical Co., Ltd.) Herein, 49 parts by weight of tetrahydrofuran is used as solvent. The resulting coating solution is coated on the charge generating layer by immersion coating, and then the coated result is dried at 120° C. for 1 hour so that a charge transporting layer having the layer thickness of 28 μm is formed. In such a manner, an R2 photoreceptor is manufactured.

(R3 Photoreceptor) ; A photoreceptor in R3 Photoreceptor was produced as in the R2 Photoreceptor except that 4.4 parts by weight of J500 (manufactured by Idemitsu Petrochemical Co., Ltd.) was replaced with G400 (manufactured by Idemitsu Petrochemical Co., Ltd.) as a polycarbonate resin in the formation of a charge transporting layer.

(R4 Photoreceptor); An undercoat layer and a charge generating layer were formed as in the R1 photoreceptor. Subsequently, in the formation of a charge transporting layer, a coating solution was prepared as in the R1 photoreceptor except that PTFE, a resin having low γ was used instead of a part of polycarbonate resins. This coating solution was coated on the charge generating layer by a dip-coating method, and dried at 120° C. for 1 hour to form a charge transporting layer having a thickness of 28 μm. In this manner, an R4 photoreceptor was produced.

As described in the foregoing, at the time of manufacturing the S1 to S6 photoreceptors and the R1 to R4 photoreceptors, a resin type and a content ratio contained in the coating solution for the charge transporting layer are changed, and the drying temperature after coating is changed to adjust γ of the surfaces of those photoreceptors to be any desired value. γ of the surfaces of those photoreceptors is measured by using a contact angle measurement device CA-X (manufactured by Kyowa Interface Science Co., Ltd.), and analytical software EG-11 (manufactured by Kyowa Interface Science Co., Ltd.)

Described next is toners those prepared for the examples and comparative examples.

(T1 and T2 Toners of Examples)

(T1 Toner); A super mixer (manufactured by Kawada Industries, Inc: V-20) is used to thoroughly mix, with respect to 100 parts by weight of resin, 1.0 part by weight of polyethylene (manufactured by Clariant Japan K. K.: PE130) as wax, 1.5 parts by weight of polypropylene (manufactured by Mitsui Chemicals, Inc: NP-505), 1 part by weight of an electrical charge control agent (manufactured by Hodogaya Chemical Co., Ltd: S-34), 1.5 parts by weight of magnetite (manufactured by Kanto Denka Kogyo CO., Ltd: KBC-100), and 5 parts by weight of carbon black (manufactured by Cabot Corp: 330R) as a coloring agent. The resulting mixture is melt and kneaded using a dual-axis kneader (manufactured by Ikegai K.K.: PCM-30). The kneaded result is crushed using a jet-type crusher (manufactured by Nippon Pneumatic Mfg. Co., LTD: IDS-2), and then sized so that the resulting toner has toner particles of 7.0 μm in volume average diameter. Thereafter, the resulting T1 toner is added with 0.3 part by weight of silica particle (manufactured by Nippon Aerosil Co., Ltd: R972) and 0.3 part by weight of magnetite (manufactured by Titan Kogyo kabushiki Kaisha: particle diameter=0.13 μm) so that a developer is manufactured.

(T2 Toner); A T2 toner of the examples is manufactured in a similar manner to the T1 toner of the examples, except that the crushing level of the kneaded result using a jet-type crusher is adjusted, and the voltage average diameter of the particles after sizing is set to 4.0 μm. Moreover, a process of additive addition is executed similarly to the T1 toner so that a developer is manufactured.

(V1 and V2 Toners of Comparative Examples)

(V1 and V2 toners); V1 and V2 toners are both manufactured in a similar manner to the T1 toner of the examples, except that the crushing level of the kneaded result using a jet-type crusher is adjusted, and the voltage average diameter of the particles after sizing is set to 8.0 μm and 3.4 μm, respectively. Moreover, a process of additive addition is executed similarly to the T1 toner so that a developer is manufactured.

The S1 to S6 photoreceptors, the R1 to R4 photoreceptors, the T1 and T2 toners, and V1 and V2 toners are placed on a digital copying machine AR-450 (manufactured by Sharp Corp.), which is modified for test use, and the evaluation test is performed for the cleaning performance and the resolution. Described next is the evaluation manner for the respective performances.

[Cleaning Performance]; A cleaning blade of a cleaning unit provided to the above digital copying machine AR-450 is so adjusted that the abutment pressure of abutting on a photoreceptor, i.e., cleaning blade pressure, is of 21 gf/cm ($2.06\times10^{-1}$ N/cm) with the initial line voltage. Under the environment of temperature: 25° C., and relative humidity: normal temperature/normal humidity of 50% (N/N: Normal Temperature/Normal Humidity), using the above copying machine, an image of a text test chart manufactured by Sharp Corp. is formed on 100,000 sheets of recording paper SF-4AM3 (manufactured by Sharp Corp).

At each stage of before image formation (0 k), 25,000 (25 k) sheets, 50,000 (50 k) sheets, and 100,000 (100 k) sheets, the formed images are subjected to visual observations to check the image sharpness of boundary portion between two colors of black and white, and whether there is any black streak resulted from toner leakage in the direction along which the photoreceptor rotates. Thereafter, a measurement device, which will be described later, is used to calculate a fog amount (Wk) so that the cleaning performance is evaluated. The fog amount Wk of the formed images is calculated by measuring the reflection density using the Z-Σ90 COLOR MEASURING SYSTEM manufactured by Nippon Denshoku Industries, Co., Ltd. First of all, an average reflection density Wr is measured for recording paper before image formation. Then, an image is formed on the recording paper, and after the image is formed thereon, white portions of the recording paper are each subjected to measurement for the reflection density. In the following expression of $\{100\times(Wr-Ws)/Wr\}$, where Ws denotes the reflection density of the portion determined that the fogging is most obvious, i.e., the white portion showing the highest density, and Wk denotes as above, the calculation result is defined as the fog amount.

The criterion for evaluating the cleaning performance is as follows:

AA: Quite satisfactory. Clear sharpness and no black streak. Fog amount Wk of less than 3%.

A: Satisfactory. Clear sharpness and no black streak. Fog amount Wk of 3% or more but less than 5%.

B: Practically no problem. Sharpness of practically-no-problem level, and 5 or less black streaks of 2.0 mm or shorter. Fog amount Wk of 5% or more but less than 10%.

C: No good for practical use. Questionable on sharpness for practical use. Black streaks exceeding the range for "B". Fog amount Wk of 10% or more. [Resolution]; The above recording paper SF-4AM3 is formed with images of 8, 10, 12, and 14 equidistant parallel lines each in a space of 1 mm, i.e., a sheet of recording paper is formed with 4 kinds of linear images varying in linear spacing in a space of 1 mm. The resulting images are subjected to visual observations, and the resolution is evaluated depending on the maximum number of lines identified out of those 4 kinds of linear images varying in linear spacing in a space of 1 mm.

The criterion for evaluating the resolution is as follows:

AA: Quite satisfactory. 14 lines/mm identified.

A: Satisfactory. 12 lines/mm identified.

B: Practically no problem. 10 lines/mm identified.

C: Poor. 8 lines/mm or fewer identified.

[Evaluation Result]

The evaluation result for the cleaning performance is shown in Tables 1 to 4. As to the evaluation test result shown in Tables 1 to 4, for the number of sheets for image formation in the respective stages (0 k, 25 k, 50 k, 100 k) after the evaluation test, when any phenomenon occurs to make the number practically not appropriate in the stage, the number of sheets is represented as endurance paper count as they may be referred to as endurance life paper count.

The S1 to S6 photoreceptors whose γ is in the range of the invention all have the evaluation result of satisfactory (A) or better, by combination with the toner T1 or T2 whose volume average diameter is in the range of the invention. Especially, with the S1 to S5 photoreceptors whose γ is in the range of 28 to 35 mN/m, the cleaning performance is quite satisfactory (AA).

On the other hand, with the R4 photoreceptor of comparative examples whose γ is smaller and not falling in the range of the invention, image failures are observed, e.g., the background fogging is often caused, and the underside of the recording paper gets dirty. This may be resulted from decreasing attachment strength of the toner with respect to the photoreceptor, and thus the transfer ratio is increased, and the toner particles are accelerated to scatter in the apparatus. Moreover, with the R1 to R3 photoreceptors of comparative examples whose γ is larger and not falling in the range of the invention, as γ is increased, the attachment strength of the toner particles is increased with respect to the photoreceptor and the cleaning blade. Thus the toner particles may be snagged on the cleaning blade, resultantly damaging the surface of the photoreceptor. As a result, the cleaning performance is reduced due to the flaws made on the surface of the photoreceptor.

With the V2 toner of the comparative examples whose volume average diameter of the toner particles is not falling in the range of the invention, the specific surface of the toner is increased. Therefore, the effects on the intermolecular forces acting on with the photoreceptor are increased pertoner particle, enabling the toner particles to pass through the cleaning blade without being eliminated from the surface of the photoreceptor. As such, the cleaning performance is reduced, and thus the stage of 25 k of the paper count is practically no good (C) for image formation.

TABLE 1

Toner in Use T1 (Volume Average Diameter of Particles 7.0 μm)

| | | Photoreceptor | γ [mN/m] | Endurance Paper Count 0k | 25k | 50k | 100k |
|---|---|---|---|---|---|---|---|
| Example | 1 | S6 | 22.00 | AA | A | A | A |
| | 2 | S1 | 28.30 | AA | AA | AA | AA |
| | 3 | S2 | 30.50 | AA | AA | AA | AA |
| | 4 | S3 | 30.50 | AA | AA | AA | AA |
| | 5 | S4 | 33.00 | AA | AA | AA | AA |
| | 6 | S5 | 34.80 | AA | AA | AA | AA |
| Comparative Example | 1 | R4 | 19.80 | B | C | C | C |
| | 2 | R1 | 36.00 | AA | AA | A | B |
| | 3 | R2 | 40.50 | A | A | C | C |
| | 4 | R3 | 44.30 | B | C | C | C |

TABLE 2

Toner in Use T2 (Volume Average Diameter of Particles 4.0 μm)

| | | Photoreceptor | γ [mN/m] | Endurance Paper Count 0k | 25k | 50k | 100k |
|---|---|---|---|---|---|---|---|
| Examples | 7 | S6 | 22.00 | A | A | A | A |
| | 8 | S1 | 28.30 | AA | AA | AA | A |
| | 9 | S5 | 34.80 | AA | AA | AA | A |
| Comparative Examples | 5 | R4 | 19.80 | B | C | C | C |
| | 6 | R1 | 36.00 | AA | A | B | C |

TABLE 3

Toner in Use V2 (Volume Average Diameter of Particles 3.4 μm)

| | | Photoreceptor | γ [mN/m] | Endurance Paper Count 0k | 25k | 50k | 100k |
|---|---|---|---|---|---|---|---|
| Comparative Examples | 7 | S6 | 22.00 | B | C | C | C |
| | 8 | S1 | 28.30 | B | C | C | C |
| | 9 | S5 | 34.80 | B | C | C | C |

TABLE 4

Toner in Use V1 (Volume Average Diameter of Particles 8.0 μm)

| | | Photoreceptor | γ [mN/m] | Endurance Paper Count 0k | 25k | 50k | 100k |
|---|---|---|---|---|---|---|---|
| Comparative Examples | 10 | S6 | 22.00 | AA | A | A | A |
| | 11 | S1 | 28.30 | AA | AA | AA | AA |
| | 12 | S5 | 34.80 | AA | AA | AA | AA |

Table 5 shows the evaluation test result for the resolution. The image resolution is controlled mainly by the diameter of the toner particles, and reducing the volume average diameter of the toner particles increases the resolution. The issue here is that when γ of the photoreceptor is less than 20 mN/m, i.e., not falling in the range of the invention, irrespective of the fact that the volume average diameter of the toner particles is in the range of the invention, observed is a phenomenon that the resolution is reduced. This may be resulted from the reducing attachment strength of the toner with respect to the photoreceptor as γ of the photoreceptor is reduced. This resultantly increases the transfer ratio and toner scattering in the apparatus, causing adverse effects to the resolution.

When the volume average diameter of the toner particles is in the range of the invention, i.e., 7 μm or smaller, and when γ on the surface of the photoreceptor is in the range of the invention, i.e., 20 mN/m or larger, the image resolution can be satisfactory.

As described above, when γ on the surface of the photoreceptor is less than 20 mN/m or exceeding 35 mN/m, the image characteristics are reduced with image fogging, cleaning poor result, and others. Even when γ on the surface of the photoreceptor is in the range of 20 to 35 mN/m, with volume average diameter of the toner particles being smaller than 4 μm, the resulting image can be high in resolution but often poor in cleaning performance. Once it exceeds 7 μm, the cleaning performance is satisfactory but the image resolution is reduced. Accordingly, in a case of satisfying the range of the invention, i.e., 20 to 35 mN/m for γ on the surface of the photoreceptor, and 4 to 7 μm for the volume average diameter of the toner particles, it became evident that the cleaning performance can be satisfactory, and the resulting images can be high in quality.

TABLE 5

| | | Photoreceptor | | Toner Particle | | |
|---|---|---|---|---|---|---|
| | | | γ[mN/m] | | Volume Average Diameter [μm] | Resolution |
| Examples | 1 | S6 | 22.00 | T1 | 7.0 | A |
| | 2 | S1 | 28.30 | T1 | 7.0 | A |
| | 3 | S2 | 30.50 | T1 | 7.0 | A |
| | 4 | S3 | 30.50 | T1 | 7.0 | A |
| | 5 | S4 | 33.00 | T1 | 7.0 | A |
| | 6 | S5 | 34.80 | T1 | 7.0 | A |
| Comparative Examples | 1 | R4 | 19.80 | T1 | 7.0 | B |
| | 2 | R1 | 36.00 | T1 | 7.0 | A |
| | 3 | R2 | 40.50 | T1 | 7.0 | A |
| | 4 | R3 | 44.30 | T1 | 7.0 | A |
| Examples | 7 | S6 | 22.00 | T2 | 4.0 | AA |
| | 8 | S1 | 28.30 | T2 | 4.0 | AA |
| | 9 | S5 | 34.80 | T2 | 4.0 | AA |
| Comparative Examples | 5 | R4 | 19.80 | T2 | 4.0 | B |
| | 6 | R1 | 36.00 | T2 | 4.0 | AA |
| | 7 | S6 | 22.00 | V2 | 3.4 | A |
| | 8 | S1 | 28.30 | V2 | 3.4 | AA |
| | 9 | S5 | 34.80 | V2 | 3.4 | AA |
| | 10 | S6 | 22.00 | V1 | 8.0 | C |
| | 11 | S1 | 28.30 | V1 | 8.0 | C |
| | 12 | S5 | 34.80 | V1 | 8.0 | C |

SECOND EXAMPLE

Describe now is a photoreceptor prepared for use as examples and comparative examples by forming a photosensitive layer with various requirements on an aluminum conductive support having the diameter of 30 mm and the length of 326.3 mm similar to the first example described above.

(S11 to S16 Photoreceptors of Examples)

(S11 photoreceptor); An S11 photoreceptor is manufactured in a similar manner to the S1 photoreceptor of the first example.

(S12 Photoreceptor); An S12 photoreceptor is manufactured in a similar manner to the S2 photoreceptor of the first example.

(S13 Photoreceptor); An S13 photoreceptor is manufactured in a similar manner to the S3 photoreceptor of the first example.

(S14 Photoreceptor); An S14 photoreceptor is manufactured in a similar manner to the S4 photoreceptor of the first example.

(S15 and S16 Photoreceptors); S15 and S16photoreceptors are manufactured in a similar manner to the S5 and S6 photoreceptors of the first example.

(R11 to R14 Photoreceptors of Comparative Examples)

(R11 Photoreceptor); An R11 photoreceptor is manufactured in a similar manner to the R1 photoreceptor of the first example.

(R12 Photoreceptor); An R12 photoreceptor is manufactured in a similar manner to the R2 photoreceptor of the first example.

(R13 Photoreceptor); An R13 photoreceptor is manufactured in a similar manner to the R3 photoreceptor of the first example.

(S14 Photoreceptor); An R14 photoreceptor is manufactured in a similar manner to the R4 photoreceptor of the first example.

As described above, at the time of manufacturing the S11 to S16 photoreceptors and R11 to R14 photoreceptors, the resin type and the content ratio contained in the coating solution for a charge transporting layer are changed, and the drying temperature after coating is also changed. Thereby, the surface free energy (γ) on the surface of the photoreceptor is adjusted to be any desired value. γ on the surface of such photoreceptors is measured by using a contact angle measurement device CA-X (manufactured by Kyowa Interface Science Co., Ltd), and analytical software EG-11 (manufactured by Kyowa Interface Science Co., Ltd).

Described next are toners prepared for the use as examples and comparative examples.

(T11 to T13 Toners of Examples)

(T11 Toner); A super mixer (manufactured by Kawada Industries, Inc.: V-20) is used to thoroughly mix, with respect to 100 parts by weight of polyester resin, 1.0 part by weight of polyethylene (manufactured by Clariant Japan K.K.: PE130) as wax, 1.5 parts by weight of polypropylene (manufactured by Mitsui Chemicals, Inc: NP-505), 1 part by weight of an electrical charge control agent (manufactured by Hodogaya Chemical Co., Ltd.: S-34), 1.5 parts by weight of magnetite (manufactured by Kanto Denka Kogyo CO., Ltd.: KBC-100), and 5 parts by weight of carbon black (manufactured by Cabot Corp.: 330R) as a coloring agent. The resulting mixture is melt and kneaded using a dual-axis kneader (manufactured by Ikegai Tekko K.K.: PCM-30) The kneaded result is crushed using a jet-type crusher (manufactured by Nippon Pneumatic Mfg. Co., LTD.: IDS-2), and then sized so that the resulting toner has toner particles of 7.0 μm in volume average diameter. Thereafter, the resulting toner is subjected to a mechanical process for a rounding-off process. A flow particle image analyzer (manufactured by Toa Medical Electronics Co., Ltd., "FPIA-2000") is used to measure the average roundness of the toner particles, and the result is 0.95. The toner is then added with 0.3 part by weight of silica particles (manufactured by Nippon Aerosil Co., Ltd.: R972) and 0.3 part by weight of magnetite (manufactured by Titan Kogyo kabushiki Kaisha: particle diameter=0.13 μm) so that the T11 toner is manufactured.

(T12 Toner); In a similar manner to the T11 toner, a jet-type crusher is used to derive toner particles having the volume average diameter of 7.0 μm. The toner particles are rounded off by mechanical and thermal processes. When the average roundness is measured in a similar manner to the T11 toner, the result is 0.96. Moreover, a process of additive addition is executed similarly to the T11 toner so that the T12 toner is manufactured.

(T13 Toner); With respect to 90 parts by weight of styrene monomer, a sand grinder is used to thoroughly knead and uniformalize 10 parts by weight of butylacrylate, 5 parts by weight of carbon black as a coloring agent, a monomer composition of 5 parts by weight of polypropylene as fusibility improving agent. As a polymerization starting agent, 1.8 parts by weight of 2,2'-azobis(2,4-dimethylvaleronitrile) is added.

TABLE 6

| | | |
|---|---|---|
| (A) | Phosphoric acid 3 sodium 12 hydrate ($Na_3PO_4/12H_20$) | 25.6 parts by weight |
| | Water | 53.4 parts by weight |
| (B) | Calcium chloride ($CaCl_2$) | 11.2 parts by weight |
| | Water | 102.0 parts by weight |
| (C) | Anion surface active agent (sodium lauryl sulfate) | 0.04 part by weight |

(A), (B), and (C) shown in Table 6 are mixed together, and based on the reaction of the following equation (8), a water-base medium including an inorganic compound with a high degree of water insolubility [$Ca_3(PO_4)_2$] is formulated.

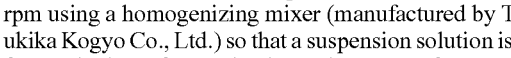

$$2Na_3PO_4+3CaCl_2 \rightarrow Ca_3(PO_4)_2+6NaCl \quad (8)$$

The monomer composition is put into the water-base medium, and is stirred and dispersed for 30 minutes at 10000 rpm using a homogenizing mixer (manufactured by Tokushukika Kogyo Co., Ltd.) so that a suspension solution is manufactured. Thereafter, under the environment of a 70° C. atmosphere of nitrogen, the result is stirred for 7 hours at 200 to 300 rpm for polymerization. After polymerization, the result is cooled down to the room temperature, and an inorganic compound with a high degree of water insolubility [$Ca_3(PO_4)_2$] is melted and eliminated using a hydrochloric solution. The result is then purified so that the suspended polymer toner having the volume average diameter of 6 μm is derived. In this manner, the T13 toner is manufactured. The average roundness of the T13 toner is measured in a similar manner to the T11 toner, and the result is 0.98.

(V11 and V12 Toners of Comparative Examples)

(V11 and V12 Toners); Using a jet-type crusher similarly to the T11 toner, derived is a toner having toner particles of 7.0 μm in volume average diameter. Through adjustment of the time taken for a mechanical process, derived are the V11 toner having the average roundness of 0.94, and the V12 toner having the average roundness of 0.945. Moreover, the addition process similar for the T11 toner is executed so that the V11 and V12 toners are manufactured. Here, the average roundness is measured in a similar manner for the T11 toner.

The S11 to S16 photoreceptors, the R11 to R14 photoreceptors, the T11 and T13 toners, and the V11 and V12 toners are placed on a digital copying machine AR-450 (manufactured by Sharp Corp.), which is modified for test use, and the evaluation test is performed for the cleaning performance and the resolution. Described next is the evaluation manner for the respective performances.

[Cleanability]; A contact pressure by which a cleaning blade of a cleaning unit mounted on the digital copying machine AR-450 is contacted with the photoreceptor, a so-called cleaning blade pressure was adjusted to 21 gf/cm ($2.06\times10^{-1}$ N/cm) in terms of an initial linear pressure. A letter test chart manufactured by Sharp Corporation was copied on 100,000 sheets of a recording paper SF-4AM3 (manufactured by Sharp Corporation) in a normal temperature/normal humidity (N/N) environment of temperature:25° C. and relative humidity: 50% using the copying machine.

At each stage of before image formation (0 k), 25,000 (25 k) sheets, 50,000 (50 k) sheets, and 100,000 (100 k) sheets, the formed images are subjected to visual observations to check the image sharpness of boundary portion between two colors of black and white, and whether there is any black streak resulted from toner leakage in the direction along which the photoreceptor rotates. Thereafter, a measurement device, which will be described later, is used to calculate a fog amount (Wk) so that the cleaning performance is evaluated. The fog amount Wk of the formed images is calculated by measuring the reflection density using the Z-Σ90 COLOR MEASURING SYSTEM manufactured by Nippon Denshoku Industries, CO., Ltd. First of all, an average reflection density Wr is measured for a recording paper before image formation. Then, an image is formed on the recording paper, and after the image is formed thereon, white portions of the recording paper are each subjected to measurement for the reflection density. In the following expression of $\{100\times(Wr-Ws)/Wr\}$, where Ws denotes the reflection density of the portion determined that the fogging is most obvious, i.e., the white portion showing the highest density, and Wk denotes as above, the calculation result is defined as the fog amount.

The criterion for evaluating the cleaning performance is as follows:

AA: Quite satisfactory. Clear sharpness and no black streak. Fog amount Wk of less than 3%.

A: Satisfactory. Clear sharpness and no black streak. Fog amount Wk of 3% or more but less than 5%.

B: Practically no problem. Sharpness of practically-no-problem level, and 5 or less black streaks of 2.0 mm or shorter. Fog amount Wk of 5% or more but less than 10%.

C: No good for practical use. Questionable on sharpness for practical use. Black streaks exceeding the range for "B". Fog amount Wk of 10% or more.

[Transfer Efficiency]

The S11 photoreceptor whose γ is 28.3 mN/m, i.e., in the range of the invention, is placed on the digital copying machine AR-450. The T11 to T13 toners, and the V11 and V12 toners are filled, respectively by 800 g, to a toner hopper being a toner storage container, and the respective toners are subjected to aging using a chart showing the image development ratio of 5%. As to the image formation requirements for aging, a setting is made to the respective toners using a Macbeth densitometer RD914 (manufactured by GretagMachbeth AG) in such a manner that the image density on a transfer paper becomes 1.3. The number of recording papers through with copying before the toner in the toner hopper is completely consumed is counted. It is evaluated that the larger the number of paper copied, the higher the transfer efficiency is.

[Evaluation Result]

The evaluation result for the cleaning performance is shown in Tables 7 and 8. As to the evaluation test result shown in Tables 7 and 8, for the number of sheets for image formation in the respective stages (0 k, 25 k, 50 k, 100 k) after the evaluation test, when any phenomenon occurs to make the number practically not appropriate in the stage, the number of sheets is represented as endurance paper count as they may be referred to as endurance life paper count.

The S11 to S16 photoreceptors whose surface free energy (γ) is in the range of the invention all have the evaluation result of satisfactory (A) or better, by combination with the toner T11 or T13 whose average roundness is in the range of the invention. Especially, with the S11 to S15 photoreceptors whose γ is in the range of 28 to 35mN/m, the cleaning performance is quite satisfactory (AA).

On the other hand, with the R14 photoreceptor of comparative examples whose γ is smaller and not falling in the range of the invention, image failures are observed, e.g., the background fogging is often caused, and the underside of the recording paper gets dirty. Thus, the stage of 25 k of the paper count is practically no good (C) for image formation. This may be resulted from decreasing attachment strength of the toner with respect to the photoreceptor, and thus the transfer ratio is increased, and the toner particles are scattered faster in the apparatus also due to the decreasing attachment strength. Moreover, with the R11 to R13 photoreceptors of comparative examples whose γ is larger and not falling in the range of the invention, as γ is increased, the toner particles and paper powder may be snagged on the cleaning blade, resultantly reducing the cleaning performance.

TABLE 7

| Toner in Use T11 (Average Roundness 0.95) | | | | | | | |
|---|---|---|---|---|---|---|---|
| | | | γ | Endurance Paper Count | | | |
| | | Photoreceptor | [mN/m] | 0k | 25k | 50k | 100k |
| Example | 10 | S16 | 22.00 | AA | A | A | A |
| | 11 | S11 | 28.30 | AA | AA | AA | AA |
| | 12 | S12 | 30.50 | AA | AA | AA | AA |
| | 13 | S13 | 30.50 | AA | AA | AA | AA |
| | 14 | S14 | 33.00 | AA | AA | AA | AA |
| | 15 | S15 | 34.80 | AA | AA | AA | AA |
| Comparative Example | 13 | R14 | 19.80 | B | C | C | C |
| | 14 | R11 | 36.00 | AA | AA | A | B |
| | 15 | R12 | 40.50 | A | A | C | C |
| | 16 | R13 | 44.30 | B | C | C | C |

TABLE 8

| Toner in Use T13 (Average Roundness 0.98) | | | | | | | |
|---|---|---|---|---|---|---|---|
| | | | γ | Endurance Paper Count | | | |
| | | Photoreceptor | [mN/m] | 0k | 25k | 50k | 100k |
| Examples | 16 | S16 | 22.00 | A | A | A | A |
| | 17 | S11 | 28.30 | AA | AA | AA | A |
| | 18 | S15 | 34.80 | AA | AA | AA | A |
| Comparative Examples | 17 | R14 | 19.80 | B | C | C | C |
| | 18 | R11 | 36.00 | AA | A | B | C |

Figure 4:
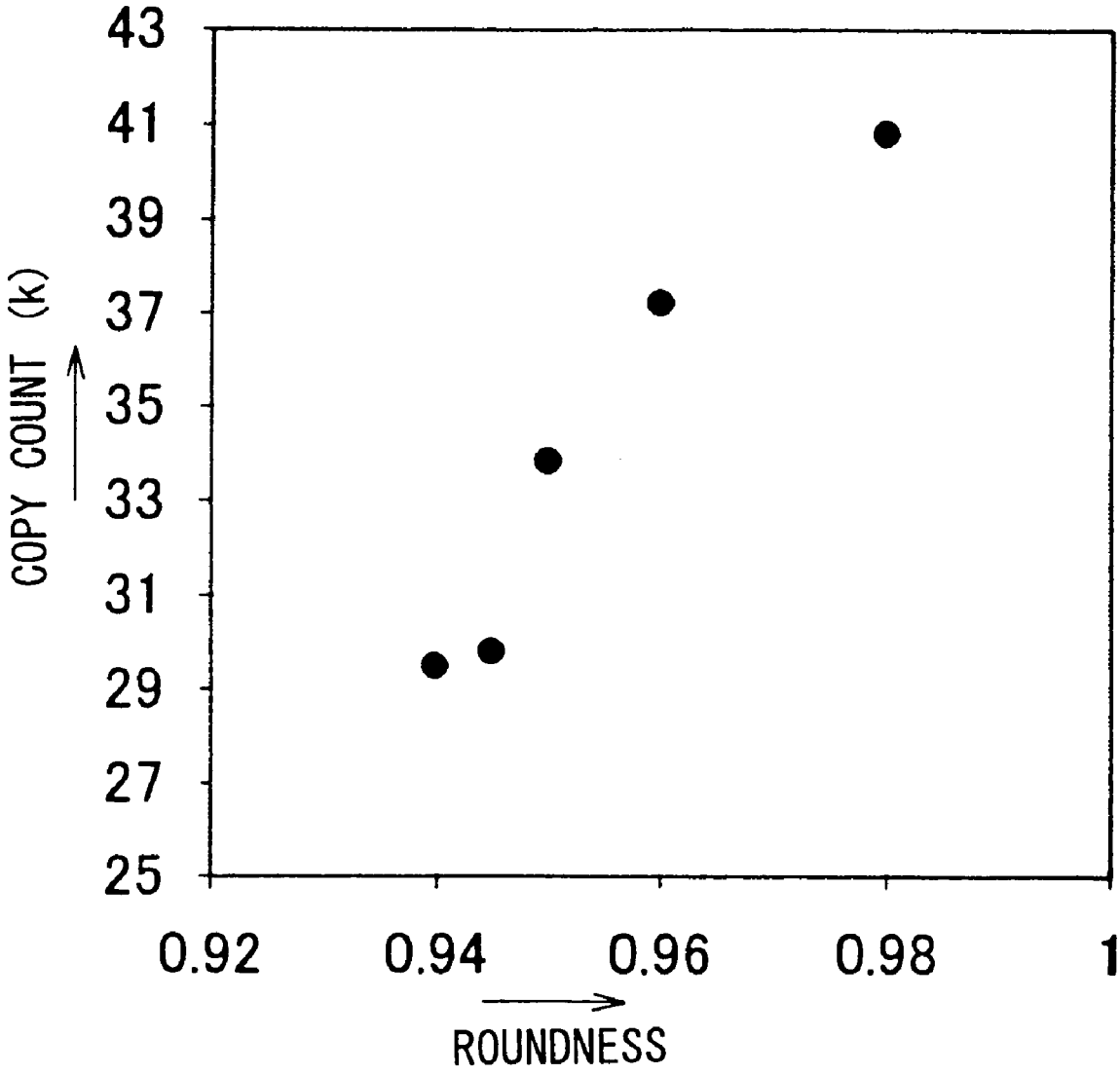
FIG. 4 is a diagram showing the relationship between the average roundness of a toner particle and a paper count for copying.
Figure 5:
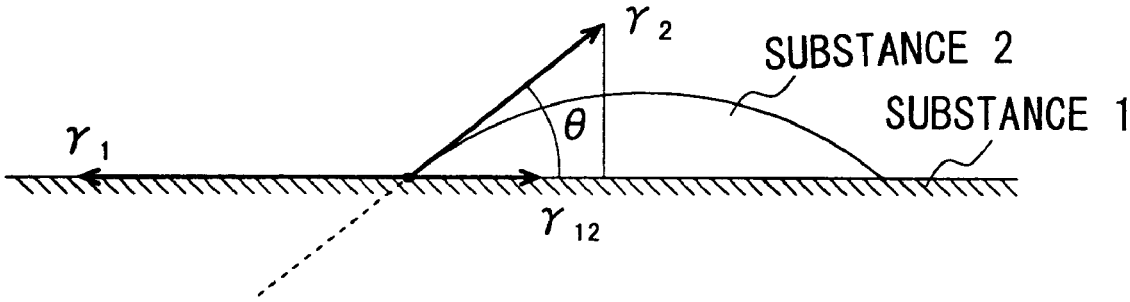
FIG. 5 is a side view showing an exemplary state of attachment leak.

Table 9 shows the evaluation result for the transfer efficiency. FIG. 4 is a diagram showing the relationship between the average roundness of the toner particles and the paper count for copying. As shown in Table 9 and FIG. 4, in a case where γ of the photoreceptor is in the range of the invention, the transfer efficiency is increased with the average roundness of 0.95 or more. As the average roundness is increased, such a tendency becomes more obvious. That is, even if the toner amount is little, with the higher average roundness of the toner particles, the more images can be formed. As such, at the time of copying an original document at a constant image development ratio, by setting the average roundness of the toner particles to be 0.95 or higher, it became evident that image formation is achieved with less toner consumption.

[Table 9]

TABLE 9

| Photoreceptor S11 in Use (γ = 28.3 mN/m) | | | | |
|---|---|---|---|---|
| | | Toner | Average Roundness | Paper Count for Copying (k) |
| Comparative Examples | 19 | V11 | 0.94 | 29.5 |
| | 20 | V12 | 0.945 | 29.8 |
| Examples | 19 | T11 | 0.95 | 33.8 |
| | 20 | T12 | 0.96 | 37.2 |
| | 21 | T13 | 0.98 | 40.8 |

THIRD EXAMPLE

Described now are photoreceptors prepared for use as examples and comparative examples by forming a photosensitive layer with various requirements on an aluminum conductive support having the diameter of 30 mm and the length of 326.3 mm similar to the first and second examples described above.

(S21 to S24 Photoreceptors of Examples)

(S21 Photoreceptor); A lower layer and a charge generating layer are formed in a similar manner to the S1 photoreceptor of the first example and the S11 photoreceptor of the second example. Thereafter, a coating solution for a charge transporting layer is formulated by mixing 5 parts by weight of styryl compound expressed by the above-described structural formula (I) as a charge transporting substance, 2.25 parts by weight of polyester resin Vylon290 (manufactured by Toyobo CO., Ltd.), 5.25 parts by weight of polycarbonate resin (G400: manufactured by Idemitsu Kosan Co., Ltd.), and 0.05 part by weight of Sumilizer BHT (manufactured by Sumitomo Chemical Co. Ltd.) Herein, 47 parts by weight of tetrahydrofuran is used as solvent. The resulting coating solution is coated on the charge generating layer by immersion coating, and then the coated result is dried for 1 hour at 110° C. so that a charge transporting layer having the thickness of 28 μm is formed. In such a manner, an S21 photoreceptor is manufactured.

(S22 Photoreceptor); An S22 photoreceptor is manufactured in a similar manner to the S2 photoreceptor of the first example and the S12 photoreceptor of the second example.

(S23 Photoreceptor); An S23 photoreceptor is manufactured in a similar manner to the S4 photoreceptor of the first example and the S14 photoreceptor of the second example.

(S24 Photoreceptor); In a similar manner to the S21 photoreceptor, a lower layer and a charge generating layer are formed. Thereafter, at the time of forming a charge transporting layer, a coating solution is formulated in a similar manner to the S22 photoreceptor, except that as a partial alternative to the polycarbonate resin, PTFE being a resin of low surface free energy (γ) is used. The resulting coating solution is coated on the charge generating layer by immersion coating, and then the coated result is dried for 1 hour at 120° C. so that a charge transporting layer having the thickness of 28 μm is formed. In such a manner, an S24 photoreceptor is manufactured.

(R21 to R23 Photoreceptors of Comparative Examples)

(R21 Photoreceptor); In a similar manner to the R1 photoreceptor of the first example and the R11 photoreceptor of the second example, an R21 photoreceptor is manufactured.

(R22 Photoreceptor); In a similar manner to the S21 photoreceptor, a lower layer and a charge generating layer are formed. Thereafter, a coating solution for a charge transporting layer is formulated by mixing 5 parts by weight of butadiene compound expressed by the above-described structural formula (II) as a charge transporting substance, two types of polycarbonate resin, i.e., 4.4 parts by weight of G400 (manufactured by Idemitsu Kosan Co., Ltd.), and 3.6 parts by weight of TS2020 (manufactured by Teijin Chemicals. Ltd.), and 0.25 part by weight of Sumilizer BHT (manufactured by Sumitomo Chemical Co. Ltd.) Herein, 49 parts by weight of tetrahydrofuran is used as solvent. The resulting coating solution is coated on the charge generating layer by immersion coating, and then the coated result is dried for 1 hour at 120° C. so that an electrical charged transport layer having the thickness of 28 μm is formed. In such a manner, an R22 photosensitive layer is manufactured.

(R23 Photoreceptor); In a similar manner to the R4 photoreceptor of the first example and the R14 photoreceptor of the second example, an R23 photoreceptor is manufactured.

As described in the foregoing, at the time of manufacturing the S21 to S24 photoreceptors and the R21 to R23 photoreceptors, by changing the resin type and the content ratio contained in the coating solution for the charge transporting layer, and by changing the drying temperature after coating as such, the surface free energy (γ) on the surface of the photoreceptor is adjusted to be any desired value. γ on the surfaces of such photoreceptors is measured by using a contact angle measurement device CA-X (manufactured by Kyowa Interface ScienceCo., Ltd.), and analytical software EG-11(manufactured by Kyowa Interface Science Co., Ltd.)

Described Next Are Toners And Carriers Used For A Developer.

(Toner)

(T21 Toner); A super mixer (manufactured by Kawada Industries, Inc.: V-20) is used to thoroughly mix, with respect to 100 parts by weight of styrene-acrylic resin, 1.0 part by weight of polyethylene (manufactured by Clariant Japan K.K.: PE130) as wax, 1.5 parts by weight of polypropylene (manufactured by Mitsui Chemicals, Inc.: NP-505), 1 part by weight of an electrical charge control agent (manufactured by Hodogaya Chemical Co., Ltd.: S-34), 1.5 parts by weight of magnetite (manufactured by Kanto Denka Kogyo CO., Ltd.: KBC-100), and 5 parts by weight of carbon black (manufactured by Cabot Corp.: 330R) as a coloring agent. The resulting mixture is melt and kneaded using a dual-axis kneader (manufactured by Ikegai Tekko K.K.: PCM-30) . The kneaded result is crushed using a jet-type crusher (manufactured by Nippon Pneumatic Mfg. Co., LTD.: IDS-2), and then sized so that the resulting toner has toner particles of 6.5 μm in volume average diameter. Thereafter, the resulting toner is added with 0.3 part by weight of silica particle (manufactured by Nippon Aerosil Co., Ltd.: R972) and 0.7 part by weight of titania particle (manufactured by Nippon Aerosil Co., Ltd.: T805) so that a T21 toner is manufactured.

(T22 Toner); A T22 toner is manufactured in a similar manner to the T21 toner, except that the addition amount of the titania particle serving as an additive (manufactured by Nippon Aerosil Co., Ltd.: T805) is 0.4 part by weight.

(V21 to V24 Toners); V21 to V24 toners are manufactured in a similar manner to the T21 toner, except that the crushing level by a jet-type crusher is adjusted to derive any desired volume average diameter. The volume average diameters of thus manufactured V21 to V24 toners are as follows: 3.40 μm for the V21 toner, 4.00 μm for the V22 toner, 7.00 μm for the V23 toner, and 8.60 μm for the V24 toner.

(Carrier)

(C1 Carrier); A C1 carrier is manufactured in such a manner that a core material is iron powder, a carrier coating solution for covering the surface of the core material is silicone, and the amount of silicone is 4.5% by weight with respect to the total amount of carrier.

(C2 Carrier); A C2 carrier is manufactured in a similar manner to the C1 carrier, except that the amount of silicone is 7.5% by weight with respect to the total amount of carrier.

Through combination among the T21 and T22 toners, the V21 to V24 toners, and the C1 and C2 carriers, the resulting toner can have the desired average amount of electrical charge. Note here that the volume average diameter of the toner particles is measured using a multisizer measurement device (manufactured by Coulter K. K.), and the average amount of electrical charge of the toner is measured using a Blow-Off TB-200 (manufactured by Toshiba Chemical K. K.).

A developer derived through combination among the S21 to S24 photoreceptors, the R21 to R23 photoreceptors, the T21 and T22 toners, the V21 to V24 toners, and the C1 and C2 carriers is placed on a digital copying machine AR-450 (manufactured by Sharp Corp.), which is modified for test use, and the evaluation test is performed for cleaning performance, filming, underside stain, and resolution. Described next is the evaluation manner for the respective performances.

[Cleaning Performance]

A cleaning blade of a cleaning unit provided to the above digital copying machine AR-450 is so adjusted that the abutment pressure of abutting on a photoreceptor, i.e., cleaning blade pressure, is of 21 gf/cm ($2.06\times10^{-1}$ N/cm) with the initial line voltage. Under the environment of temperature: 25° C., and relative humidity: normal temperature/normal humidity of 50% (N/N: Normal Temperature/Normal Humidity), using the above copying machine, an image of a text test chart manufactured by Sharp Corp. is formed on 100,000 sheets of recording paper SF-4AM3 (manufactured by Sharp Corp.). Here, in this example, this text test chart and the recording paper are also used in other evaluation tests, which will be described later.

At each stage of before image formation (0 k), 50,000 (50 k) sheets, and 100,000 (100 k) sheets, the formed images are subjected to visual observations to check the image sharpness of boundary portion between two colors of black and white, and whether there is any black streak resulted from toner leakage in the direction along which the photoreceptor rotates. Thereafter, a measurement device, which will be described later, is used to calculate a fog amount (Wk) so that the cleaning performance is evaluated. The fog amount Wk of the formed images is calculated by measuring the reflection density using the Z-Σ90 COLOR MEASURING SYSTEM manufactured by Nippon Denshoku Industries, CO., Ltd. First of all, an average reflection density Wr is measured for recording paper before image formation. Then, an image is formed on the recording paper, and after the image is formed thereon, white portions of the recording paper are each subjected to measurement for the reflection density. In the following expression of $\{100\times(Wr-Ws)/Wr\}$, where Ws denotes the reflection density of the portion determined that the fogging is most obvious, i.e., the white portion showing the highest density, and Wk denotes as above, the calculation result is defined as the fog amount.

The criterion for evaluating the cleaning performance is as follows:

AA: Quite satisfactory. Clear sharpness and no black streak. Fog amount Wk of less than 3%.

A: Satisfactory. Clear sharpness and no black streak. Fog amount Wk of 3% or more but less than 5%.

B: Practically no problem. Sharpness of practically-no-problem level, and 5 or less black streaks of 2.0 mm or shorter. Fog amount Wk of 5% or more but less than 10%.

C: No good for practical use. Questionable on sharpness for practical use. Black streaks exceeding the range for "B". Fog amount Wk of 10% or more.

[Filming]

Filming is a phenomenon that the residual toner particles left on the surface of the photoreceptor form a film attached substance by being repeatedly subjected to the processes of electrification, electrostatic latent image formation, image development, image transfer, and cleaning. After 50 k and 100 k image formation, the images formed on the surface of the photoreceptor and the recording paper are subjected to visual observations for evaluation. The criterion for evaluating the filming is as follows:

A: No filming on photoreceptor. Satisfactory level.

B: Some filming on photoreceptor. Practically-no-problem level.

C: Some filming on photoreceptor. Questionable level for image quality.

[Underside Stain]

After 100 k for image formation, several sheets of recording paper having been subjected to image formation immediately before the paper count reaches 100 k are subjected to visual observations for evaluation of its underside stain. The criterion for evaluating the underside stain is as follows:

A: No underside stain on recording paper. Satisfactory level.

B: Some underside stains on recording paper, but practically-no-problem level.

C: Some underside stains on recording paper, and questionable level for practical use.

[Resolution]

The above recording paper SF-4AM3 is formed with images of 8, 10, 12, and 14 equidistant parallel lines each in a space of 1 mm, i.e., a sheet of recording paper is formed with 4 kinds of linear images varying in linear spacing in a space of 1 mm. The resulting images are subjected to visual observations, and the resolution is evaluated depending on the maximum number of lines identified out of those 4 kinds of linear images varying in linear spacing in a space of 1 mm. The criterion for evaluating the resolution is as follows:

AA: Quite satisfactory. 14 lines/mm identified.

A: Satisfactory. 12 lines/mm identified.

B: Practically no problem. 10 lines/mm identified.

C: Poor. 8 lines/mm or fewer identified.

[Evaluation Result]

The evaluation result is shown in Tables 10 and 11. As to the evaluation result shown in Tables 10 and 11, for the number of sheets for image formation in the respective stages (0 k, 50 k, 100 k) after the evaluation test, when any phenomenon occurs to make the number practically not appropriate in the stage, the number of sheets is represented as endurance paper count as they may be referred to as endurance life paper count.

The table 10 shows the result derived by evaluating the cleaning performance, filming, and underside stain in a case of using the T21 and T22 toners both having the volume average diameter of 6.5 μm. With the S21 to S24 photoreceptors whose surface free energy (γ) is in the range of the invention, when toners as the combination results of the T21 and T22 toners and the C1 and C2 carriers have the average amount of electrical charge in the range of the invention, their cleaning performance is all satisfactory (A) or better. Especially, with the S21 to S23 photoreceptors whose γ is in the range of 28 to 35 mN/m, the cleaning performance is quite satisfactory (AA) . Further, when γ of the photoreceptor is in the range of 20 to 35 mN/m, and when the average amount of electrical charge of the toner is in the range of 10 to 30 μC/g, it became evident that no filming occurs, and higher-quality image formation is achieved.

When γ of the photoreceptor is in the range of 20 to 35 mN/m, but when the average amount of electrical charge of the toner is less than 10 μC/g, the toner particles scatter, and the underside stains are observed. On the other hand, when the average amount of electrical charge of the toner exceeds 30 μC/g, this reduces the cleaning performance, and image fogging and black streaks are observed.

With the R23 photoreceptor of the comparative examples whose γ is smaller and not falling in the range of the invention, even if the average amount of electrical charge of the toner is in the range of 10 to 30 μC/g, the image failures are observed, e.g., the background fogging is often caused, and the underside of the recording paper gets dirty. This may be resulted from decreasing attachment strength of the toner or others with respect to the photoreceptor, and thus the transfer ratio is increased, and the toner particles are scattered faster in the apparatus also due to the decreasing attachment strength. Moreover, with the R21 and R22 photoreceptors of comparative examples whose γ is larger and not falling in the range of the invention, even if the average amount of electrical charge of toner is in the range of 10 to 30 μC/g, the attachment strength of the toner, paper powder, and others is increased as γ is increased, resultantly reducing the cleaning performance.

TABLE 10

| | | | | | Toner Charge | 0k | 50k | | 100k | | Underside | Endurance |
|---|---|---|---|---|---|---|---|---|---|---|---|---|
| Test No. | Photo-receptor | γ (mN/m) | Toner | Carrier | amount (μC/g) | Cleaning Performance | Filming | Cleaning Performance | Filming | Cleaning Performance | Stains after 100k | Paper Count |
| 1 | S24 | .00 | T21 | C1 | 8.9 | AA | A | A | A | A | C | 50k |
| 2 | S24 | .00 | T21 | C2 | 10.5 | AA | A | A | A | A | A | 100k |
| 3 | S24 | .00 | T22 | C1 | 29.4 | AA | A | A | A | A | A | 100k |
| 4 | S24 | .00 | T22 | C2 | 33.0 | A | B | A | C | A | A | 50k |
| 5 | S21 | 28.30 | T21 | C1 | 8.9 | AA | A | A | A | A | C | 50k |
| 6 | S21 | 28.30 | T21 | C2 | 10.5 | AA | A | AA | A | AA | A | 100k |
| 7 | S21 | 28.30 | T22 | C1 | 29.4 | AA | A | AA | A | AA | A | 100k |
| 8 | S21 | 28.30 | T22 | C2 | 33.0 | A | B | A | C | A | A | 50k< |
| 9 | S22 | 30.50 | T21 | C1 | 8.9 | AA | A | A | A | A | B | 50k |
| 10 | S22 | 30.50 | T21 | C2 | 10.5 | AA | A | AA | A | AA | A | 100k |
| 11 | S22 | 30.50 | T22 | C1 | 29.4 | AA | A | AA | A | AA | A | 100k |
| 12 | S22 | 30.50 | T22 | C2 | 33.0 | A | B | B | C | C | A | 50k< |
| 13 | S23 | 34.80 | T21 | C1 | 8.9 | AA | A | A | A | A | B | 50k |
| 14 | S23 | 34.80 | T21 | C2 | 10.5 | AA | A | AA | A | AA | A | 100k |
| 15 | S23 | 34.80 | T22 | C1 | 29.4 | AA | A | AA | A | AA | A | 100k |
| 16 | S23 | 34.80 | T22 | C2 | 33.0 | A | B | B | C | C | A | 50k< |
| 17 | R23 | 19.80 | T21 | C1 | 8.9 | A | A | C | A | C | C | 50k< |
| 18 | R23 | 19.80 | T21 | C2 | 10.5 | A | A | B | A | C | B | 50k< |
| 19 | R23 | 19.80 | T22 | C1 | 29.4 | A | A | B | A | C | B | 50k< |
| 20 | R23 | 19.80 | T22 | C2 | 33.0 | A | A | B | A | B | B | 50k |
| 21 | R21 | 36.00 | T21 | C1 | 8.9 | A | A | B | B | B | A | 50k |
| 22 | R21 | 36.00 | T21 | C2 | 10.5 | A | A | B | C | C | A | 50k |
| 23 | R21 | 36.00 | T22 | C1 | 29.4 | A | B | B | C | C | A | 50k< |
| 24 | R21 | 36.00 | T22 | C2 | 33.0 | A | B | C | C | C | A | 50k< |
| 25 | R22 | 44.30 | T21 | C1 | 8.9 | A | A | B | C | C | A | 50k< |
| 26 | R22 | 44.30 | T21 | C2 | 10.5 | A | B | B | C | C | A | 50k< |
| 27 | R22 | 44.30 | T22 | C1 | 29.4 | B | B | C | C | C | A | 50k< |
| 28 | R22 | 44.30 | T22 | C2 | 33.0 | B | C | C | C | C | A | 50k< |

Table 11 shows the result derived by evaluating the cleaning performance and the resolution in a case of using the S22 photoreceptor whose γ is 30.50 mN/m, and using toners varying in the volume average diameter. Even if the average amount of electrical charge of the toner is in the range of 10 to 30 μC/g, and even if γ of the photoreceptor is in the range of 20 to 35 mN/m, with the toner particles having the volume average diameter of 4 μm or less, the cleaning performance is reduced even with satisfactory resolution. With the toner particles having the volume average diameter exceeding 7 μm, the resolution is reduced.

TABLE 11

| Test No. | Photoreceptor | γ (mN/m) | Toner Particle Diameter (μm) | Carrier | Toner Charge Amount (μC/g) | 100k Resolution | 100k Cleaning Performance |
|---|---|---|---|---|---|---|---|
| 29 | S22 | 30.50 | V21(3.40) | C1 | 29.4 | AA | C |
| 30 | S22 | 30.50 | V22(4.00) | C1 | 27.1 | AA | A |
| 11 | S22 | 30.50 | T22(6.50) | C1 | 29.4 | AA | AA |
| 31 | S22 | 30.50 | V23(7.00) | C1 | 24.6 | A | A |
| 32 | S22 | 30.50 | V24(8.60) | C1 | 22.3 | C | A |

Fourth Embodiment

Described now is a photoreceptor prepared for use as examples and comparative examples by forming a photosensitive layer with various requirements on an aluminum conductive support having the diameter of 30 mm and the length of 326.3 mm similar to the first to third examples.

(S31 to S36 Photoreceptors of Examples)

(S31 Photoreceptor); An S31 photoreceptor is manufactured in a similar manner to the Si photoreceptor of the first example and the S11 photoreceptor of the second example, except that a charge transporting layer has the layer thickness of 22 μm.

(S32 Photoreceptor); An S32 photoreceptor is manufactured in a similar manner to the S2 photoreceptor of the first example, the S12 photoreceptor of the second example, and the S22 photoreceptor of the third example, except that a charge transporting layer has the layer thickness of 22 μm.

(S33 Photoreceptor); An S33 photoreceptor is manufactured in a similar manner to the S3 photoreceptor of the first example and the S13 photoreceptor of the second example, except that a charge transporting layer has the layer thickness of 22 μm.

(S34 Photoreceptor); An S34 photoreceptor is manufactured in a similar manner to the S4 photoreceptor of the first example, the S14 photoreceptor of the second example, and the S23 photoreceptor of the third example, except that a charge transporting layer has the layer thickness of 22 μm.

(S35 and S36 Photoreceptors); S35 and S36photoreceptors are manufactured in a similar manner to the S5 and S6 photoreceptors of the first example, and the S15 and S16 photoreceptors of the second example, except that a charge transporting layer has the layer thickness of 22 μm.

(R31 to R33 Photoreceptors of Comparative Examples)

(R31 Photoreceptor); An R31 photoreceptor is manufactured in a similar manner to the R1 photoreceptor of the first example, the R11 photoreceptor of the second example, and the R21 photoreceptor of the third example, except that a charge transporting layer has the layer thickness of 22 μm.

(R32 Photoreceptor); An R32 photoreceptor is manufactured in a similar manner to the R2 photoreceptor of the first example, and the R12 photoreceptor of the second example, except that a charge transporting layer has the layer thickness of 22 μm.

(R33 Photoreceptor); An R33 photoreceptor is manufactured in a similar manner to the R4 photoreceptor of the first example, the R14 photoreceptor of the second example, and the R23 photoreceptor of the third example, except that a charge transporting layer has the layer thickness of 22 μm.

As described in the foregoing, at the time of manufacturing the S31 to S36 photoreceptors of the examples and the R31 to R33 photoreceptors of the comparative examples, by changing the resin type and the content ratio contained in the coating solution for a charge transporting layer, and by changing the drying temperature after coating, γ on the surface of the photoreceptor is adjusted to be any desired value. γ on the surface of such photoreceptors is measured by using a contact angle measurement device CA-X (manufactured by Kyowa Interface Science Co., Ltd.), and analytical software EG-11 (manufactured by Kyowa Interface Science Co., Ltd.).

(Manufacturing of Bonding Resin)

(Resin A); As raw materials, 1,4-butanediol, fumaric acid, trimellitic anhydride, and hydroxyine are put into a 5-liter four-neck flask provided with a nitrogen induction pipe, a dewatering pipe, a stirrer, and a thermocouple. The result undergoes reaction for 5 hours at 160° C., and then is increased in temperature up to 200° C. The result undergoes reaction for 1 hour. Thereafter, the result undergoes reaction again for 1 hour under the decompression atmosphere of 8.3 kPa so that a resin A is manufactured.

(Resin B); As raw materials, BPA-PO, BPA-EO, terephthalic acid, dodecenylsuccinic anhydride, trimellitic anhydride, and 4 g of dibutyltin oxide are put into a 5-liter four-neck flask provided with a dewatering pipe, a stirrer, and a thermocouple. The result undergoes reaction for 8 hours at 220° C., and then undergoes reaction again under the decompression atmosphere of 8.3 kPa until it reaches a predetermined softening point so that a resin B is manufactured.

(Resin C); As raw materials, BPA-PO, BPA-EO, terephthalic acid, fumaric acid, trimellitic anhydride, and 4 g of dibutyltin oxide are put into a 5-liter four-neck flask provided with a dewatering pipe, a stirrer, and a thermocouple. The result undergoes reaction for 8 hours at 220° C., and then undergoes reaction again under the decompression atmosphere of 8.3 kPa until it reaches a predetermined softening point so that a resin C is manufactured.

(Manufacturing of Toner)

(T31 Toner); A Henschel mixer is used to thoroughly mix a total of 100 parts by weight consisting of 10 parts by weight of resin A, 60 parts by weight of resin B and 30 parts by weight of resin C as bonding resins, 5 parts by weight of carbon black "Morgul L" (manufactured by Cabot Corp.), 5 parts by weight of polypropylene wax "biscoal (phonetically written) 550P" (manufactured by Sanyo Chemical Industries, Ltd: melting point: 140° C.), and 1 part by weight of charge control agent "S-34" (manufactured by Orient Chemical Industries, Ltd). The resulting mixture is then melt and kneaded using a dual-axis kneader. The kneaded result is then crushed using a high-speed jet-mill crusher and sizer "type IDS-2" (Nippon Pneumatic Mfg. Co.) The kneaded result is crushed and sized to have the volume average diameter of 8 μm. The resulting T31 toner has Tg of 58° C., and the average roundness (a) of 0.945. To this T31 toner, a portion of commercial silica whose primary particles have the average diameter of 0.1 μm is mixed and dispersed so that an addition process is executed thereto.

(T32 Toner); The process before crushing and sizing is similar to the T31 toner. Thereafter, a rounding-off process is executed using a mechano fusion system manufactured by Hosokawa Micron Corp. Thus derived T32 toner has Tg of 58° C., and the average roundness (a) of 0.960. Thereafter, similarly to the T31 toner, an addition process is executed.

(T33 Toner); In a similar manner to the T31 toner, a T33 toner is manufactured, except that a bonding resin includes 70 parts by weight of resin B, and 30 parts by weight of resin C, i.e., 100 parts by weight in total. The resulting T33 toner has Tg of 63° C., and the average roundness (a) of 0.945. Thereafter, similarly to the T31 toner, an addition process is executed.

(T34 Toner); Into 710 g of ion exchange water in a 2-liter four-neck flask, 450 g of 0.1 M-$Na_3PO_4$ aqueous solution is put. The solution is heated to 60° C., and is then stirred at 12000 rpm using a homogenizing mixer of high-speed stirrer TK type (manufactured by Tokushukika Kogyo Co., Ltd.) To the result, 68 g of 1.0M-$CaC1_2$ aqueous solution is added by degrees, and thus derived is a water dispersion medium including a small-particle dispersion stabilizer with a high degree of water insolubility.

On the other hand, substances of Table 12 are prepared as dispersoid, and an ebaramilder (phonetically written) (manufactured by Ebara Corp.) is used to premix carbon black serving as a coloring agent, A1 compound of di-tert-butylsalicylic acid, and styrene. Thereafter, everything shown in Table 12 is heated to 60° C., and then melted and dispersed to derive a monomer mixture. Then, while the temperature is retained at 60° C., the mixture is added with 10 g of a starting agent 2, 2'-azobis(2,4-dimethylvaleronitrile) and melted. In this manner, a monomer composition is formulated.

TABLE 12

| | |
|---|---|
| Styrene | 160 g |
| n-butylacrylate | 40 g |
| Carbon Black "Mogul L" (manufactured by Cabot Corp.) | 8 g |
| A1 compound of 2,5-di-tert-butylsalicylic acid | 4 g |
| Polypropylene Wax (softening point 135° C.) | 10 g |
| Saturated Polyester Resin | 10 g |

Into a water dispersion medium formulated in a 2-liter flask of a homogenizing mixer, the above-described monomer composition is put. Using a TK homogenizing mixer under the 60° C. atmosphere of nitrogen, the result is stirred for 20 minutes at 10000 rpm so that a monomer composition is manufactured. Thereafter, the composition undergoes reaction for 6 hours at 60° C. while being stirred by a paddle stirrer, and then is polymerized for 10 hours at 80° C.

After polymerization reaction, the reaction compound is cooled, and then added with hydrochloric acid to melt $Ca_3(PO_4)_2$. The result is then filtered, washed, and dried so that a T34 toner of volume average diameter of about 8 μm is derived. Thus derived T34 toner has Tg of 59° C., and the average roundness (a) of 0.980. Thereafter, similar to the T31 toner, an addition process is executed.

(T35 Toner); The process before crushing and sizing is similar to the T31 toner. Thereafter, a rounding-off process is executed using a mechano fusion system manufactured by Hosokawa Micron Corp. The time for the rounding-off process is made shorter than that for manufacturing the T32 toner, and derived is a T35 toner having the average roundness (a) of 0. 950. The T35 toner has Tg of 58° C. Thereafter, similar to the T31 toner, an addition process is executed.

After the addition process is executed, 8 portions of the respective T31 to T35 toners are mixed with 92 portions of iron carriers (manufactured by Kanto Denka Kogyo Co., Ltd.) so that a developer is derived.

[Low-Temperature Fusibility and Hot Offset]

The S33 photoreceptor of the examples is placed on a digital copying machine AR-200 (manufactured by Sharp Corp.), and using the manufactured T31 to T33 toners, image formation is performed while the heating roller of the fuser is sequentially increased in temperature from 90° C. to 240° C. In the following manner, a measurement is carried out for the minimum fusing temperature and the hot offset temperature.

(Minimum Fusing Temperature)

Using the above copying machine, manufactured is a solid-filled image of 3 cm×3 cm with the image density of 1.35 or more. Here, the image density is measured by a densitometer RD-915 (manufactured by GretagMachbeth AG). A sand eraser having the bottom size of 15 mm ×7.5 mm is prepared. This sand eraser is put on a load of 1 kg, and the image is rubbed for 3 times, back and forth. The image density is measured before and after such rubbing, and a ratio Dr of the image density D2 after rubbing to the image density D1 before rubbing (D2/D1 ) is calculated. When the image density ratio Dr exceeds 70% for the first time, the temperature of the heating roller at that time is defined as the minimum fusing temperature. The evaluation is so made that the toner has the better low-temperature fusibility with the lower minimum fusing temperature. The evaluation criterion is as follows.

A (Satisfactory): Lower than 160° C.

B (Good) : 160° C. or higher but lower than 175° C.

C (Poor): 175° C. or higher (Hot OFFSET Temperature)

Image formation is carried out on recording paper, and the resulting image is passed through a fuser that is set with various temperatures for an image fixation process. Here, formed is an image in which a portion covering an area of 2 cm from one end of the recording paper is solid-filled with the image density of 1.35, and the remaining portions are all white. The temperature of the heating roller causing toner stains on the white portions is defined as the hot offset temperature. The evaluation is so made that the hot offset is the more satisfactory (this means that the hot offset is hardly observed) with the higher hot offset temperature. The evaluation criterion is as follows.

A (Satisfactory): 210° C. or higher

B (Good) : 190° C. or higher but lower than 210° C.

C (Poor): Lower than 190° C.

Table 13 shows the evaluation result. The T31 and T32 toners show good fusibility at such a low temperature as lower than 160° C. As to the T33 toner, because Tg is high as 63° C., the result shows that the low-temperature fusibility is poor. The result shows satisfactory hot offset no matter which toner is used.

TABLE 13

| | | Toner | Tg (° C.) | Low-Temperature Fusibility | Hot Offset |
|---|---|---|---|---|---|
| Examples | 22 | T31 | 58 | A | A |
| | 23 | T32 | 58 | A | A |
| Comparative Example | 21 | T33 | 63 | C | A |

[Cleaning Performance]

A cleaning blade of a cleaning unit provided to a digital copying machine AR-200 (manufactured by Sharp Corp.) is so adjusted that the abutment pressure of abutting on a photoreceptor, i.e., cleaning blade pressure, is of 21 gf/cm ($2.06\times10^{-1}$ N/cm) with the initial line voltage. Under the environment of temperature: 25° C., and relative humidity: normal temperature/normal humidity of 50% (N/N: Normal Temperature/Normal Humidity), using the T31 toner and the T33 toner, a durability test is performed for printing of 30,000 sheets. For the printing durability test, an original document with the image density of 5% is used. At each stage of before image formation (0 k), 5,000 (5 k) sheets, 15,000 (15 k) sheets, and 30,000 (30 k) sheets, the formed image is subjected to visual observations to check the image sharpness of boundary portion between two colors of black and white, and whether there is any black streak resulted from toner leakage in the direction along which the photoreceptor rotates. Thereafter, a measurement device, which will be described later, is used to calculate a fog amount (Wk) so that the cleaning performance is evaluated. The fog amount Wk of the formed images is calculated by measuring the reflection density using the Z-Σ90 COLOR MEASURING SYSTEM manufactured by Nippon Denshoku Industries, CO., Ltd. First of all, an average reflection density Wr is measured for recording paper before image formation. Then, an image is formed on the recording paper, and after the image is formed thereon, white portions of the recording paper are each subjected to measurement for the reflection density. In the following expression of $\{100\times(Ws-Wr)/Wr\}$, where Ws denotes the reflection density of the portion determined that the fogging is most obvious, i.e., the white portion showing the highest density, and Wk denotes as above, the calculation result is defined as the fog amount.

The criterion for evaluating the cleaning performance is as follows:

AA: Quite satisfactory. Clear sharpness and no black streak. Fog amount Wk of less than 3%.

A: Satisfactory. Clear sharpness and no black streak. Fog amount Wk of 3% or more but less than 5%.

B: Practically no problem. Sharpness of practically-no-problem level, and 5 or less black streaks of 2.0 mm or shorter. Fog amount Wk of 5% or more but less than 10%.

C: No good for practical use. Questionable on sharpness for practical use. Black streaks exceeding the range for "B". Fog amount Wk of 10% or more.

Table 14 shows the evaluation result of the test using the T31 toner, and Table 15 shows the evaluation result of the test using the T33 toner. In either cases of using such toners, when γ of the photoreceptor is 20 mN/m or more but 35 mN/m or less, the result shows good cleaning performance. However, when γ exceeds 35 mN/m, this increases the attachment strength of the toner to the photosensitive material too much due to the large interaction between the photoreceptor and the toner, thereby causing the poor cleaning result. Moreover, with the R33 photoreceptor whose γ is less than 20 mN/m, the toner particles scatter because the attachment strength between the photoreceptor and the toner is not enough. What is more, the image fogging is observed as a result of such toner scattering.

TABLE 14

| | | Photoreceptor | γ (mN/m) | Copy Count 0 | 5000 | 15000 | 30000 |
|---|---|---|---|---|---|---|---|
| Examples | 24 | S31 Photoreceptor | 28.4 | AA | AA | AA | AA |
| | 25 | S32 Photoreceptor | 30.5 | AA | AA | AA | AA |
| | 26 | S33 Photoreceptor | 30.0 | AA | AA | AA | AA |
| | 27 | S34 Photoreceptor | 33.1 | AA | AA | AA | AA |
| | 28 | S35 Photoreceptor | 34.8 | AA | AA | AA | AA |
| | 29 | S36 Photoreceptor | 22.0 | AA | AA | A | A |
| Comparative Examples | 22 | S31 Photoreceptor | 36.2 | AA | AA | A | B |
| | 23 | S32 Photoreceptor | 40.2 | A | B | C | C |
| | 24 | S33 Photoreceptor | 19.6 | A | A | C | C |

TABLE 15

| | | Photoreceptor | γ (mN/m) | Copy Count 0 | 5000 | 15000 | 30000 |
|---|---|---|---|---|---|---|---|
| Examples | 30 | S31 Photoreceptor | 28.4 | AA | AA | AA | AA |
| | 31 | S32 Photoreceptor | 30.5 | AA | AA | AA | AA |
| | 32 | S33 Photoreceptor | 30.0 | AA | AA | AA | AA |
| | 33 | S34 Photoreceptor | 33.1 | AA | AA | AA | AA |
| | 34 | S35 Photoreceptor | 34.8 | AA | AA | AA | AA |
| | 35 | S36 Photoreceptor | 22.0 | AA | AA | AA | A |
| Comparative Examples | 25 | S31 Photoreceptor | 36.2 | AA | AA | AA | A |
| | 26 | S32 Photoreceptor | 40.2 | A | A | B | C |
| | 27 | S33 Photoreceptor | 19.6 | A | A | C | C |

Next, the S32 photoreceptor is placed on a digital copying machine AR-200 (manufactured by Sharp Corp.), and a cleaning blade of a cleaning unit provided to a copying machine is so adjusted that the initial line voltage is of 8 gf/cm ($0.784\times10^{-1}$ N/cm), 12 gf/cm ($1.176\times10^{-1}$ N/cm), 21 gf/cm ($2.06\times10^{-1}$ N/cm), 35 gf/cm ($3.43\times10^{-1}$ N/cm), and 45 gf/cm ($4.41\times10^{-1}$ N/cm). Under the N/N environment of temperature: 25° C., and relative humidity: 50%, using the T31 toner, a durability test is performed for printing of 30,000 sheets for the respective line voltages to evaluate the cleaning performance. The evaluation of the cleaning performance is made based on the above-described black streaks and fog amount Wk. After such a durability test for printing 30,000 sheets, the film thickness, i.e., the layer thickness of the photosensitive layer is measured using an instantaneous multi photometric measurement system MCPD-1100 (manufactured by Otsuka Electronics Co.,Ltd.) by interference of light. The evaluation is so made that the durability is the poorer with the thinner layer thickness after the durability test for printing 30,000 sheets.

Table 16 shows the evaluation result of the cleaning performance and the measurement result of the layer thickness. When the line voltage of the cleaning blade is 10 gh/cm or more but 35 gf/cm or less, the result shows that the good cleaning performance, and the layer is not suffered from too much abrasion as harming the capability of the photoreceptor. When the line voltage of the cleaning blade is less than 10 gf/cm, the cleaning performance is considerably reduced as the residual toner particles left on the photoreceptor pass through the cleaning blade. Conversely, when the line voltage exceeds 35 gf/cm, this causes no problem to the cleaning performance but causes too much layer abrasion that the photosensitive layer of the photoreceptor is vanished at the time when paper printing is through with 15 k. Thereafter, the durability test cannot be continued.

TABLE 16

| | | Line Voltage of Cleaning Blade (gf/cm) | Copy Count (sheet) 0 | 5000 | 15000 | 30000 | Final Layer Thickness at 30000 sheets (μm) |
|---|---|---|---|---|---|---|---|
| Examples | 36 | 12 | AA | AA | A | A | 20.1 |
| | 37 | 21 | AA | AA | AA | AA | 18.4 |
| | 38 | 35 | AA | AA | AA | AA | 16.3 |
| Comparative Examples | 28 | 8 | C | C | C | C | 21.0 |
| | 29 | 45 | AA | AA | C | C | 0.0 |

[Consumption Amount of Toner]

The S3 photoreceptor of the examples is placed on the digital copying machine AR-200, and the initial line voltage of a cleaning blade is so adjusted as to be 21 gf/cm. The T31 toner, the T32 toner, the T34 toner, and T35 toner are filled, respectively by 600 g, to toner cartridges of a copying machine, and under the N/N environment of temperature: 25° C., and relative humidity: 50%, a durability test is performed until the toners are completely consumed using an original document having the image density of 5%. The evaluation is so made that the toner consumption amount is saved to a greater degree as the more number of printed paper sheets is larger at the time when the toners are completely consumed.

Table 17 shows the test result. Here, no matter which toner is used, the image quality (image density) after the durability test is in the similar level to that at the initial stage (0 k sheet). Although the durable paper count is not affected even if the average roundness (a) is 0.945, using toners having the higher average roundness (a) increases the transfer efficiency. Accordingly, it becomes possible to print many imaging of any desired density with the less amount of toner.

TABLE 17

| | | Toner | Average Roundness (a) | Copy Count (sheet) with 600 g Toner |
|---|---|---|---|---|
| Examples | 39 | T32 toner | 0.960 | 19700 |
| | 40 | T34 Toner | 0.980 | 21200 |
| | 41 | T35 Toner | 0.950 | 18900 |
| | 42 | T31 Toner | 0.945 | 17200 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, a setting is so made that the volume average diameter of toner particles included in a developer is 4 μm or larger but 7 μm or smaller, and the surface energy on the surface of an electrophotographic photoreceptor is 20 mN/m or more but 35 mN/m or less, preferably 28 mN/m or more but 35 mN/m or less.

The surface free energy on the surface of the electrophotographic photoreceptor serves as an index of the attachment strength of the toner with respect to the surface of the electrophotographic photoreceptor. On the other hand, with the aim of improving the image quality and resolution, as the toner particles are reduced in size, the specific surface being the surface area of the toner particles per unit weight is increased. This greatly affects the inter molecular forces, and thus the attachment strength is increased with respect to the electrophotographic photoreceptor. When the size of the toner particles is set to be 4 to 7 μm, which is a range suitable for increasing the image quality and resolution, by setting the surface free energy of the electrophotographic photoreceptor to the above-described suitable range, it becomes possible to provide the toner particles with the attachment strength of the level needed for image development while suppressing excessive attachment strength. Therefore, the toner, especially the remaining toner can be easily eliminated from the surface of the electrophotographic photoreceptor.

As such, it becomes possible to increase the cleaning performance without lowering the image development performance, and thus implemented is an image forming apparatus that shows good cleaning performance even with using size-reduced toner particles, and is capable of stably forming high-quality high-resolution images over a long period of time.

Also, according to the invention, a setting is so made that the average roundness of the toner particles included in the developer is 0.95 or more, and the surface energy on the surface of the electrophotographic photoreceptor is 20 mN/m or more but 35 mN/m or less, preferably 28 mN/m or more but 35 mN/m or less.

With the aim of improving the image quality and resolution, the small-sized toner particles are shaped rounder, and as the average roundness thereof is increased, the toner particles become uniformly charged to a further degree. By setting the average roundness of the toner particles to 0.95 or more, the toner particles become uniformly charged to a further degree as such, thereby implementing image formation achieving high-quality and high-resolution. Although increasing the average roundness of the toner particles generally leads to a difficulty of scraping the toner particles remaining on the surface of the electrophotographic photoreceptor using a cleaning blade, by setting the surface free energy of the electrophotographic photoreceptor to the above-described suitable range, it becomes possible to provide the toner particles with the attachment strength of the level needed for image development while suppressing excessive attachment strength. Therefore, the remaining toner particles can be scraped using the cleaning blade with ease, favorably implementing the good cleaning performance. What is more, by setting the surface free energy of the electrophotographic photoreceptor to the above-described suitable range, it becomes possible to increase the transfer efficiency being the transfer ratio from the surface of the electrophotographic photoreceptor to the transfer material. As such, it becomes possible to control the amount of toner particles to be left on the element surface.

As such, without lowering the image development performance, it becomes possible to increase the transfer efficiency and control the amount of toner particles to be left on the element surface, and thus even if any toner particles are left on the element surface, thus left toner particles are easily scraped by a cleaning blade, favorably realizing the good cleaning performance. Therefore, implemented is an image forming apparatus that shows good transfer efficiency and cleaning performance even with using round-shaped toner particles of higher-average-roundness, and is capable of stably forming high-quality high-resolution images over a long period of time.

Further, according to the invention, a setting is so made that the average amount of electrical charge of the toner included in the developer is 10 μC/g or more but 30 μC/g or less, and the surface free energy on the surface of the electrophotographic photoreceptor is 20 mN/m or more but 35 mN/m or less, preferably 28 mN/m or more but 35mN/m or less. The surface free energy on the surface of the electrophotographic photoreceptor and the average amount of electrical charge of the toner both serve as an index of the attachment strength of the toner with respect to the surface of the electrophotographic photoreceptor. By setting the surface free energy of the electrophotographic photoreceptor and the average amount of electrical charge of the toner to the above-described suitable range, it becomes possible to provide the attachment strength of the level needed for image development while suppressing excessive attachment strength between the electrophotographic photoreceptor and the toner. Therefore, the remaining toner particles can be scraped using a cleaning blade with ease, favorably realizing the good cleaning performance. As such, the good cleaning performance can be realized without lowering the image development performance, implemented is an image forming apparatus that is capable of stably forming high-quality high-resolution images over a long period of time.

Still further, according to the invention, the volume average diameter of the toner particles is set to be 4 to 7 μm. By reducing the diameter of the toner particles as such, the resulting images can be high in quality and resolution. On the other hand, as the toner particles are reduced in diameter as such, the specific surface which is the surface area of the toner particles per unit weight is increased. This greatly affects the intermolecular forces, and thus the attachment strength is increased with respect to the electrophotographic photoreceptor. However, by setting the surface free energy of the electrophotographic photoreceptor to be in a suitable range, it becomes possible to provide the toner particles with the attachment strength of the level needed for image development while suppressing excessive attachment strength. Therefore, the toner particles especially the remaining toner particles can be scraped with ease from the surface of the electrophotographic photoreceptor. As such, implemented is an image forming apparatus that shows good cleaning performance even with using size-reduced toner particles, and is capable of stably forming high-quality high-resolution images over a long period of time.

Still further, according to the invention, a setting is so made to the toner that the glass transition temperature (Tg) exceeds 20° C. but lower than 60° C., and the surface free energy (γ) on the surface of the electrophotographic photoreceptor is 20 mN/m or more but 35 mN/m or less, preferably 28 mN/m or more but 35 mN/m or less. The surface free energy on the surface of the electrophotographic photoreceptor serves as an index of the attachment strength of the toner with respect to the surface of the electrophotographic photoreceptor.

As described in the foregoing, the toner has the characteristics of low-melting point, and thus can save the consumption energy in the image fixation process of fixing a toner image onto a transfer material serving as a recording medium. The issue here is that the low-melting toner easily causes filming by attaching onto the surface of the electrophotographic photoreceptor. However, because the surface free energy of the electrophotographic photoreceptor is set to a low range of 20 to 35 mN/m, even if the toner particles attach on the surface of the electrophotographic photoreceptor, those can be eliminated with ease by a cleaning blade passing thereover. This is thanks to low interaction between the toner and the surface of the electrophotographic photoreceptor, thereby leading to the good cleaning performance. In such a manner, implemented is an image forming apparatus that is free from poor cleaning result even with using a low-melting toner.

Still further, according to the invention, the toner is provided with the low-temperature fusibility, and additionally, the toner particles are so shaped as to have the average roundness of 0.950 or more. By setting the average roundness of the toner particles to 0.950 or more, the toner particles become uniformly charged to a greater extent so that high-quality high-resolution image formation is implemented. Although increasing the average roundness of the toner particles generally leads to a difficulty of scraping the toner particles remaining on the surface of the electrophotographic photoreceptor using a cleaning blade, by setting the surface free energy of the electrophotographic photoreceptor to the range of 20 to 35 mN/m, it becomes possible to provide the toner particles with the attachment strength of the level needed for image development while suppressing excessive attachment strength. Therefore, the remaining toner particles can be scraped using the cleaning blade with ease, favorably implementing the good cleaning performance. What is more, by setting the surface free energy of the electrophotographic photoreceptor to the above-described suitable range, it becomes possible to increase the transfer efficiency being the transfer ratio from the surface of the electrophotographic photoreceptor to the transfer material. As such, it becomes possible to control the amount of toner particles to be left on the element surface.

As such, without lowering the image development performance, it becomes possible to increase the transfer efficiency and control the amount of toner particles to be left on the element surface, and thus even if any toner particles are left on the element surface, thus left toner particles are easily scraped by a cleaning blade, favorably realizing the good cleaning performance. Therefore, implemented is an image forming apparatus that shows good transfer efficiency and cleaning performance even with using round-shaped toner particles of higher-average-roundness, and is capable of stably forming high-quality high-resolution images over a long period of time.

Still further, according to the invention, a setting is so made that the line voltage of the cleaning blade provided to the cleaning means falls in the range of 10 to 35 gf/cm with respect to the electrophotographic photoreceptor. On the other hand, because the surface free energy of the electrophotographic photoreceptor is set to the range of 20 to 35 mN/m, the interaction between the toner particles and the electrophotographic photoreceptor is controlled, i.e., the toner particles are so controlled as not to attach too much onto the surface of the electrophotographic photoreceptor. Therefore, even with the relatively-low line voltage of the cleaning blade as described above, the toner particles remaining on the surface of the electrophotographic photoreceptor are easily eliminated, thereby causing no poor cleaning result. What is more, because the line voltage of the cleaning blade is low with respect to the electrophotographic photoreceptor, the electrophotographic photoreceptor is controlled not to suffer from abrasion, and the useful life of the apparatus is lengthened. As such, implemented is an image forming apparatus that is free from poor image quality resulted from the poor cleaning result even with the long-term use.

Still further, according to the invention, the photosensitive layer of the electrophotographic photoreceptor is made of an organic photoconductive material. This eases material design of the electrophotographic photoreceptor, thereby realizing the lower cost and higher-efficient production.

Still further, according to the invention, the photosensitive layer of the electrophotographic photoreceptor has such a configuration that a charge generating layer including a charge generating substance is overlaid on a charge transporting layer including a charge transporting substance. With such a configuration type that the photosensitive layer includes a plurality of layers overlaid on one another, the flexibility is increased for material selection and material combination for the respective layers. Therefore, it becomes easy to set the surface free energy on the surface of the electrophotographic photoreceptor to any desired range.

The invention claimed is:

1. An image forming apparatus, comprising:

an electrophotographic photoreceptor provided with a photosensitive layer that is exposed to light corresponding to image information for formation of an electrostatic latent image;

developing means for developing the electrostatic latent image and forming a toner image by supplying a toner included in a developer onto the surface of the photosensitive layer itself of the electrophotographic photoreceptor;

transfer means for transferring the toner image to a transfer material serving as a recording medium; and cleaning means for eliminating residual toner particles left on the surface of the electrophotographic photoreceptor after the toner image is transferred to the transfer material, wherein the toner comprises a bonding resin, a coloring agent, a wax, and an electrical charge control agent, and further the toner contains a coloring agent comprised of 1 to 10 parts by weight of magnetite with respect to 100 parts by weight of the resin, the toner is manufactured by crushing the melt-kneaded mixture of said bonding resin, coloring agent, wax, electrical charge control agent, and magnetite, the photosensitive layer consists of a charge generating layer containing a charge generating substance and a charge transporting layer containing a charge transporting substance thereon, and the toner is supplied on the surface of the charge transporting layer, a volume average diameter of the toner particles included in the developer is 4 μm or larger but 7 μm or smaller, and a surface free energy (γ) on the surface of the photosensitive layer of the electrophotographic photoreceptor is 20 mN/m or more but 35 mN/m or less.

2. The image forming apparatus of claim 1, wherein the surface free energy (γ) on the surface of the photosensitive layer of the electrophotographic photoreceptor is 28 mN/m or more but 35 mN/m or less.

3. The image forming apparatus of claim 1, wherein the photosensitive layer of the electrophotographic photoreceptor is made of an organic photoconductive material.

* * * * *